US006896363B2

(12) United States Patent
Oshima et al.

(10) Patent No.: US 6,896,363 B2
(45) Date of Patent: May 24, 2005

(54) DISCHARGE DEVICE OF MEDIUM AND LIQUID EMITTING APPARATUS HAVING THE DISCHARGE DEVICE

(75) Inventors: Keiichi Oshima, Nagano-ken (JP); Satoshi Kaneta, Nagano-ken (JP); Hiroki Nakashima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 45 days.

(21) Appl. No.: 10/383,789

(22) Filed: Mar. 7, 2003

(65) Prior Publication Data

US 2003/0234852 A1 Dec. 25, 2003

(30) Foreign Application Priority Data

Mar. 7, 2002 (JP) ..... 2002-062046
Feb. 21, 2003 (JP) ..... 2003-044063

(51) Int. Cl.[7] ..... B41J 2/01; B41J 3/00; B41J 11/58

(52) U.S. Cl. ..... 347/104; 347/101; 347/2; 347/107; 400/625

(58) Field of Search ..... 347/104, 101, 347/2, 107; 400/625

(56) References Cited

U.S. PATENT DOCUMENTS 4,070,966 A * 1/1978 Edon ..... 101/269
5,673,074 A * 9/1997 Miyauchi et al. ..... 347/104
6,148,722 A * 11/2000 Hagstrom ..... 101/35
6,550,907 B2 * 4/2003 Uchida ..... 347/104
6,612,762 B1 * 9/2003 Sakurai et al. ..... 400/542
6,619,792 B1 * 9/2003 Roberts et al. ..... 347/101
2002/0126192 A1 * 9/2002 Kawaguchi et al. ..... 347/104

FOREIGN PATENT DOCUMENTS

EP 0 983 861 A2 3/2000 ..... B41J/13/00
EP 1 190 857 A2 3/2002 ..... B41J/2/01
JP 2000-158738 6/2000
JP 2000-192782 7/2002
JP 2002-192782 7/2002
WO WO 97/01798 1/1997 ..... G03G/13/20

OTHER PUBLICATIONS

European Search Report dated Dec. 15, 2003.

* cited by examiner

*Primary Examiner*—Lamson Nguyen
*Assistant Examiner*—Leonard Liang
(74) *Attorney, Agent, or Firm*—Edwards & Angell, LLP; John J. Penny, Jr.

(57) ABSTRACT

A discharge device for discharging a medium, includes: a discharge-driving roller, provided in a downstream of a liquid emitting head for emitting liquid onto the medium, for being driven to rotate; a discharge-driven roller, biased by a biasing mechanism toward the discharge-driving roller, for being brought into contact with the discharge-driving roller to be rotated by the discharge-driving roller; a discharge frame, to which the discharge-driven roller is attached, having a posture changeable between a contact posture that brings the discharge-driven roller into contact with the discharge-driving roller and a release posture that moves the discharge-driven roller away from the discharge-driving roller; and an engagement portion, provided on the discharge frame, for engaging with an outside region of the medium inserted between the discharge-driving roller and the discharge-driven roller toward an upstream against a force applied by the biasing mechanism, the outside region being a region other than a liquid-emitted region of the medium onto which the liquid is to be emitted, wherein the medium is discharged by rotation of the discharge-driving roller, and the outside region of the medium moves the engagement portion away to change the posture of the discharge frame from the contact posture to the release posture, when the medium is inserted between the discharge-driving roller and the discharge-driven roller toward the upstream.

11 Claims, 21 Drawing Sheets

DISCHARGE DEVICE OF MEDIUM AND LIQUID EMITTING APPARATUS HAVING THE DISCHARGE DEVICE

This patent application claims priority from both Japanese patent applications No.2002-62046 filed on Mar. 7, 2002 and No.2003-44063 filed on Feb. 21, 2003, the contents of which are incorporated herein by reference.

BACKGROUND OF THE INVENTION

1. Field of the Invention

The present invention relates to a discharge device for discharging a medium, such as recording paper for which recording is performed, by rotation of a discharge-driving roller, and a liquid emitting apparatus including the above discharge device, such as an ink-jet type recording apparatus.

The term "liquid emitting apparatus" is used for referring not only to a recording apparatus, such as a printer, a copier and a facsimile machine, having an ink-jet type recording head for emitting ink from the recording head so as to perform recording on a recording medium but also to an apparatus that causes liquid to adhere onto a medium, corresponding to the recording medium in the above recording apparatus, by emitting the liquid selected depending on the use of the apparatus in place of the ink toward the medium from a liquid emitting head corresponding to the recording head in the above recording apparatus.

As the liquid emitting head, the following heads can be considered other than the above recording head: a color-material emitting head used for fabrication of a color filter for a liquid crystal display or the like, an electrode-material (conductive paste) emitting head used for forming an electrode in an organic EL display or a field-emission display (FED), a bioorganic compound emitting head used for fabrication of a bio-chip and a sample spraying head as a precision pipette.

2. Description of the Related Art

In order to describe a liquid emitting apparatus, an ink-jet type recording apparatus (hereinafter, referred to as a "printer") and a compact disc (hereinafter, simply referred to as a "CD") are described as an example of the liquid emitting apparatus and a medium onto which the liquid is emitted or a medium for which the recording is performed. Some printers can emit drops of ink, that is in form of liquid, directly onto a surface of the CD (labeled surface) opposite to a surface thereof on which digital data was recorded, thereby performing the printing operation. In this case, in order to transfer the CD along a transfer path in the printer, the CD is placed in an exclusive tray for transfer (hereinafter, simply referred to as a "carrying tray") because the CD is a small circular disk. The CD is subjected to the printing operation while being placed in the carrying tray.

In a certain type of printer, a discharge roller of the printer, that is arranged to discharge paper or printing medium out of the printer, is formed by a discharge-driving roller, that is driven to rotate so as to discharge the printed medium, and a discharge-driven roller, that is in resilient contact with the discharge-driving roller so as to be rotated by the discharge-driving roller. The driven roller may be a toothed roller that is arranged to be brought in point-contact with the recorded surface of the recorded medium by teeth. In such a printer, when the toothed roller is brought into contact with the recorded surface of the CD as the recorded medium while the CD is pressed, a data storage area of the CD in which data was stored, that is positioned directly below the recorded surface, may be damaged. Thus, in order to prevent the aforementioned problem, it is necessary to arrange the discharge roller of the printer so as to allow the toothed roller to be moved to a non-contact position where the toothed roller is not in contact with the driving roller of the discharge roller during the printing for the CD, thereby preventing the contact of the toothed roller with the recorded surface of the CD. Therefore, a discharge frame to which the toothed roller is attached is arranged to be changeable between a contact posture in which the toothed roller is in contact with the discharge-driving roller and a non-contact posture in which the toothed roller and the discharge-driving roller are away from each other.

According to conventional techniques, a mechanism for changing the posture of the discharge frame between contact and release postures is achieved by an operation lever and a link mechanism that links a switching operation by the operation lever to the change of the posture of the discharge frame (for example, described in Japanese Patent Application Laid-Open No. 2002-192782).

The above-mentioned conventional arrangement, however, becomes complicated because the operation lever and the link mechanism are included, thereby increasing the number of parts of the arrangement and the cost. Moreover, precision of the moving amount of the toothed roller is low because the toothed roller is moved by the operation lever and the link mechanism. In some cases, the toothed roller is brought in contact with the recording surface of the CD although the data storage area of the CD is not broken.

SUMMARY OF THE INVENTION

Therefore, it is an object of the present invention to provide a discharge device for discharging a medium and a liquid emitting apparatus using the same, which are capable of overcoming the above drawbacks accompanying the conventional art. The above and other objects can be achieved by combinations described in the independent claims. More specifically, it is an object of the present invention to provide a simple arrangement for releasing a discharge-driven roller from a discharge-driving roller at a reduced cost and for moving the discharge-driven roller with high precision. The dependent claims define further advantageous and exemplary combinations of the present invention.

According to the first aspect of the present invention, a discharge device for discharging a medium, comprises: a discharge-driving roller, provided in a downstream of a liquid emitting head for emitting liquid onto the medium, operable to be driven to rotate; a discharge-driven roller, biased by a biasing mechanism toward the discharge-driving roller, operable to be brought into contact with the discharge-driving roller to be rotated by the discharge-driving roller; a discharge frame, to which the discharge-driven roller is attached, having a posture changeable between a contact posture that brings the discharge-driven roller into contact with the discharge-driving roller and a release posture that moves the discharge-driven roller away from the discharge-driving roller; and an engagement portion, provided on the discharge frame, operable to engage with an outside region of the medium inserted between the discharge-driving roller and the discharge-driven roller toward an upstream against a force applied by the biasing mechanism, the outside region being a region other than a liquid-emitted region of the medium onto which the liquid is to be emitted, wherein the medium is discharged by rotation of the discharge-driving roller, and the outside region of the medium moves the engagement portion away to change the posture of the discharge frame from the contact posture to the release posture, when the medium is inserted between the discharge-driving roller and the discharge-driven roller toward the upstream.

According to the above, the outside region of the medium inserted between the discharge-driving roller and the discharge-driven roller toward the upstream directly moves the engagement portion away so as to move the discharge frame, thereby releasing the discharge-driven roller from the discharge-driving roller. Thus, an operation lever and a link mechanism conventionally used for changing the posture of the discharge frame from the contact posture to the release posture, making the arrangement simple and reducing the cost. In addition, an improper operation by a user can be prevented. Moreover, since the medium itself moves the discharge frame, that is, the engagement portion directly, it is possible to move the discharge-driven roller with higher precision as compared to a case where the operation lever and the link mechanism are used for changing the posture of the discharge frame.

The aforementioned medium is used for referring to a medium that can be transferred on a transfer path in a liquid emitting apparatus such as an ink-jet type recording apparatus, for example, paper, board, a disk-carrying tray onto which an optical disk is placed in a case of directly printing on a labeled surface of the optical disk such as a compact disc, and etc.

The discharge frame may be arranged in such a manner that an upstream side thereof is pivotable around a pivot center at a downstream side thereof, and the engagement portion being provided on the upstream side of the discharge frame.

A plurality of discharge-driven rollers may be arranged at intervals in an width direction of the medium that is perpendicular to a direction along which the medium is transferred, and the engagement portion may be arranged in the vicinity of an outermost one of the discharge-driven rollers that is located at an end in the transverse direction.

The engagement portion may be arranged on a side opposite to a reference position side determining a reference position of the medium in the width direction.

The engagement portion may be formed by a body of rotation that is brought into contact with the medium to be rotated.

In this case, the medium can be inserted smoothly with no load since the engagement portion is formed by the body of rotation. Also, the medium cannot be damaged by the engagement portion.

The discharge-driven roller may be a toothed roller having teeth on its outer circumference.

In a case where an optical disk is used as the medium, the toothed roller having teeth on its outer circumference, that can be brought into point-contact with the surface of the medium may break a data storage area of the optical disk that is positioned directly below the surface onto which the liquid is to be emitted, when the toothed roller is brought into contact with the optical disk strongly. However, according to the present invention, the discharge-driven roller can be moved away without fail, as described above. Therefore, even if the toothed roller is used as the discharge-driven roller, the data storage area of the optical disk cannot be damaged.

The engagement portion may be arranged in a region other than a region where the liquid emitting head is able to emit the liquid.

In this case, the engagement portion cannot obstruct a transfer operation for transferring the medium because the medium travels within the region where the liquid emitting head can emit the liquid.

The discharge device may further comprise an advance roller that includes: an advance-driving roller, provided in the downstream of the discharge-driving roller, operable to be driven to rotate; and an advance-driven roller, biased by a biasing mechanism toward the advance-driving roller, operable to be brought into contact with the advance-driving roller to be rotated by the advance-driving roller.

The medium is precisely transferred by a transfer roller provided in the upstream of the liquid emitting head toward the downstream of the liquid emitting head. In a case where liquid is emitted without leaving margin on the medium (no-margin printing), it is necessary to transfer the medium by the discharge-driving roller and the discharge-driven roller both provided in the downstream of the liquid emitting head after the trail end of the medium went out of the transfer roller. However, in an ink-jet type recording apparatus that performs printing by emitting ink drops onto the medium or the like, the medium cannot be nipped securely by the discharge-driving roller and the discharge-driven roller in order to prevent ink transfer or the like. Therefore, the quality of liquid emission, i.e., printing quality may be degraded in the no-margin printing.

Moreover, in a case where only one pair of rollers are provided for transferring the medium toward the downstream of the liquid emitting head, when the trail end of the medium went out of the transfer roller, the trail end is elevated because the top end trails down. Therefore, the surface for which the liquid is to be emitted (printing surface) may be brought into contact with the liquid emitting head or a distance between the liquid emitting head and the medium may be varied, thus degrading the quality of liquid emission. However, according to the present invention, the advance roller is provided as another pair of rollers on the downstream of the discharge-driving roller and the discharge-driven roller. Thus, even when the trail end of the medium went out of the transfer roller, the medium is nipped by the two pairs of rollers and therefore the aforementioned disadvantage can be prevented.

The discharge device may further comprise: an adapter attachment portion to which a positioning adapter for supporting the medium from the beneath the medium and regulating a position of the medium in a column direction when the medium is manually inserted from the downstream of the advance roller to the upstream of the transfer roller, is attached; and a roller release member, provided to be brought into contact with an outer circumference of the advance-driven roller, operable to moves the advance-driven roller away from the advance-driving roller against the biasing mechanism when being in contact with the outer circumference of the advance-driven roller, wherein a part of the positioning adapter is brought into contact with the roller release member to move the transfer-driven roller away from the transfer-driving roller, when the positioning adapter was attached to the adapter attachment portion.

In this discharge device, when the medium is manually inserted from the downstream of the advance-driving roller, the positioning adapter is attached to the adapter attachment portion. The medium is fed and discharged via the positioning adapter.

According to the present invention, a part of the positioning adapter is brought into contact with the roller release member that can be brought into contact with the outer circumference of the advance-driven roller, when the positioning adapter is attached to the adapter attachment portion, thereby the advance-driven roller is released from the advance-driving roller.

Thus, the advance-driven roller is always away from the advance-driving roller when the medium is fed via the positioning adapter. Therefore, improper operation by a user can be prevented and the advance-driven roller can be moved away from the surface of the medium onto which the liquid emission is to be performed without fail, thereby an appropriate result of liquid emission can be obtained.

The advance-driven roller may be an elastic roller that is brought into fact-contact with the medium resiliently.

In this case, it is hardly for the advance-driven roller to cut the surface of the medium because the advance-driven roller is brought into face-contact with the medium. Therefore, even in a case of the optical disk having the data storage area directly below the labeled surface onto which the liquid is to be emitted, the data storage area cannot be damaged.

According to the second aspect of the present invention, a liquid emitting apparatus comprises: a liquid emitting head operable to emit liquid toward a medium; and a discharge device, provided in a downstream of the liquid emitting head, operable to discharge the medium outside the apparatus, wherein the discharge device is any of discharge devices mentioned above.

Thus, the liquid emitting head of the present invention can achieve the same effects as the advantageous effects mentioned above.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

Figure 1:
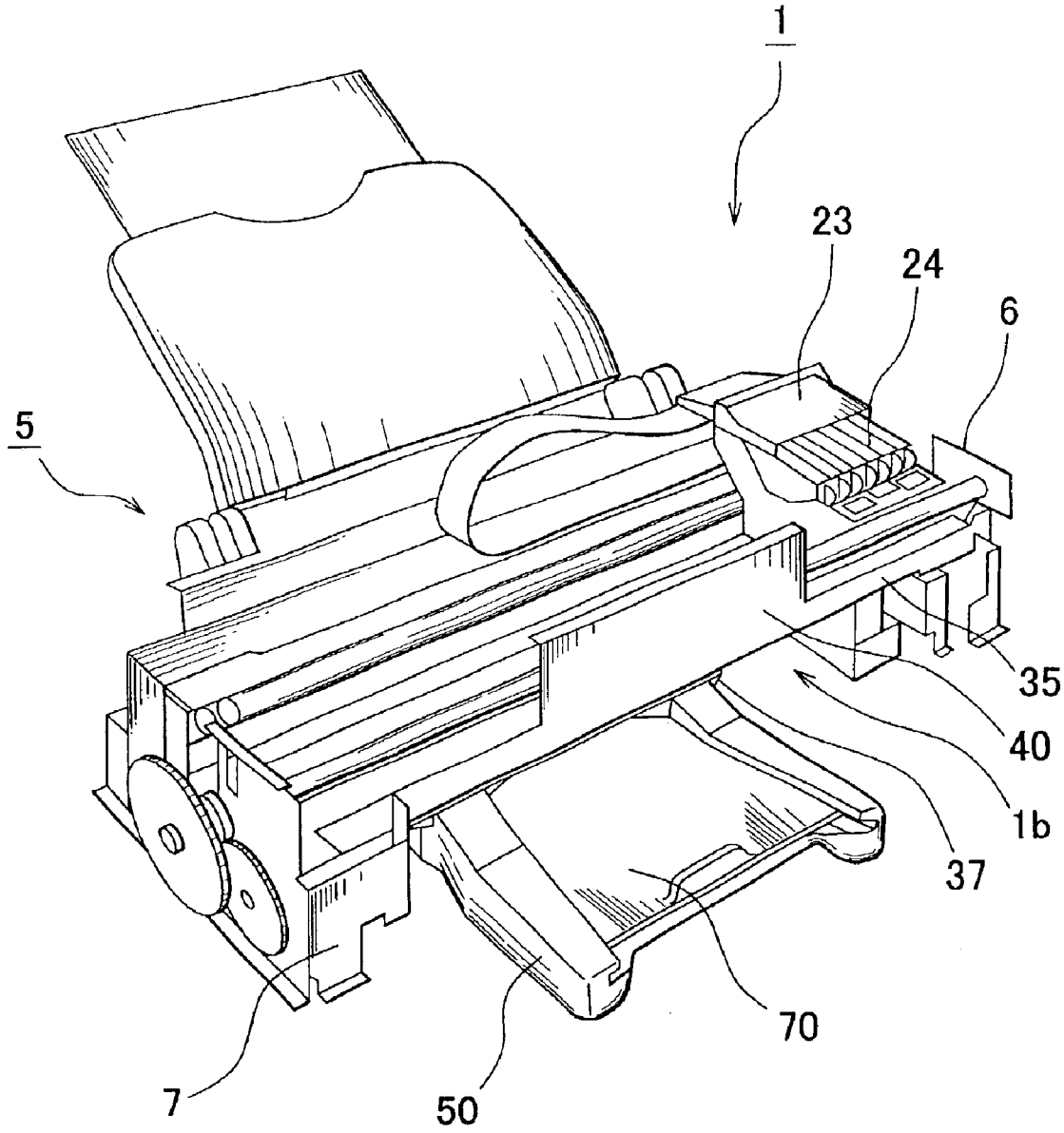
FIG. 1 is a perspective view showing an appearance of an ink-jet printer according to the present invention.

The invention will now be described based on the preferred embodiments, which do not intend to limit the scope of the present invention, but exemplify the invention. All of the features and the combinations thereof described in the embodiment are not necessarily essential to the invention.

Referring to the drawings, embodiments of a discharge device of the present invention that can discharge a medium onto which liquid (ink) was emitted and a liquid emitting apparatus of the present invention including the above discharge device are described based on an example of an ink-jet type recording apparatus in the following order.

1. Arrangement of the ink-jet type recording device
2. Arrangement of the first paper-discharge driven roller
3. Arrangement of the second paper-discharge driven roller
4. Attachment of a discharge frame
5. Arrangement of a release mechanism for the second paper-discharge driven roller <1. Arrangement of the Ink-jet Type Recording Device>

Figure 2:
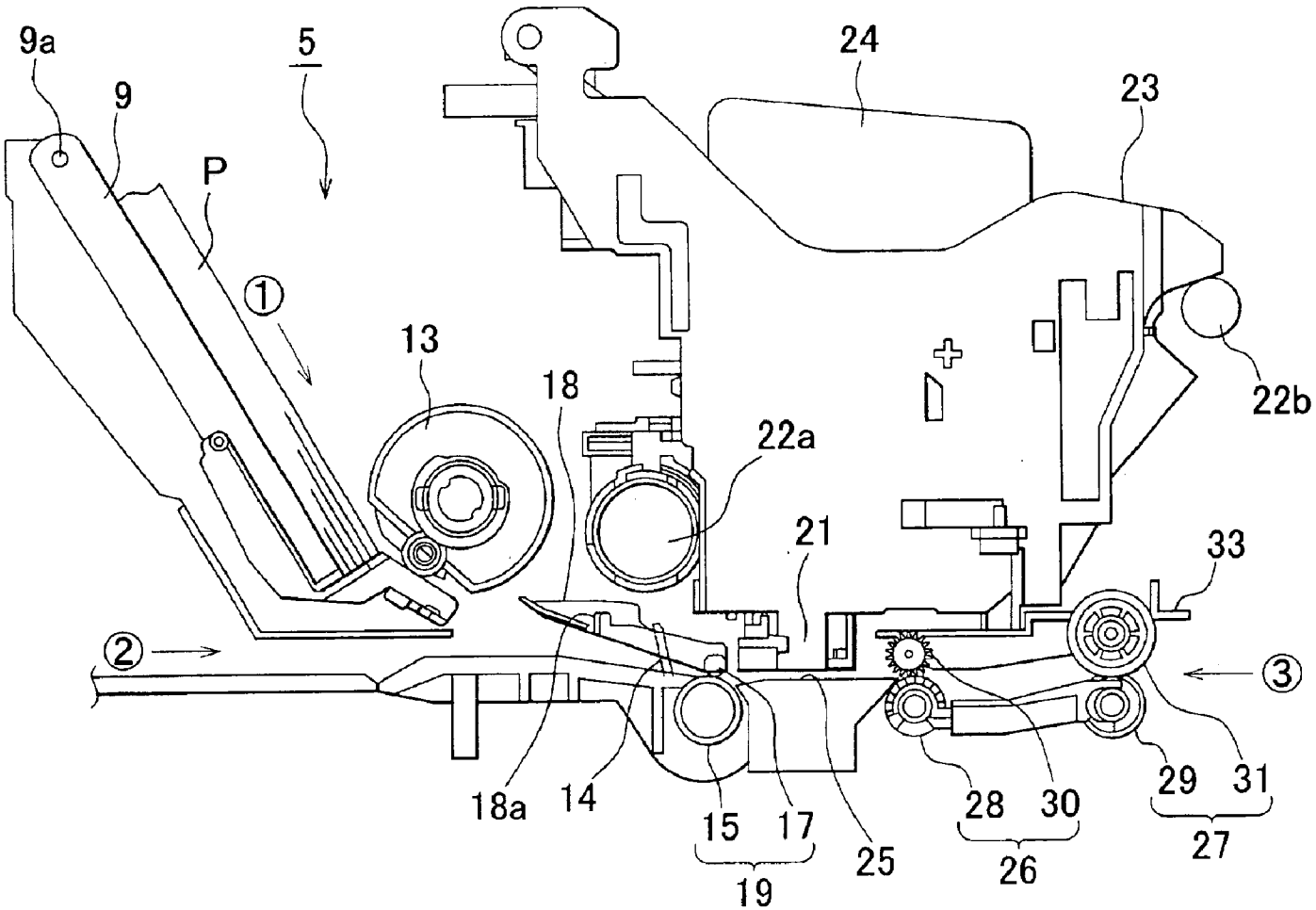
FIG. 2 is a cross-sectional view of the ink-jet printer according to the present invention.
Figure 3:
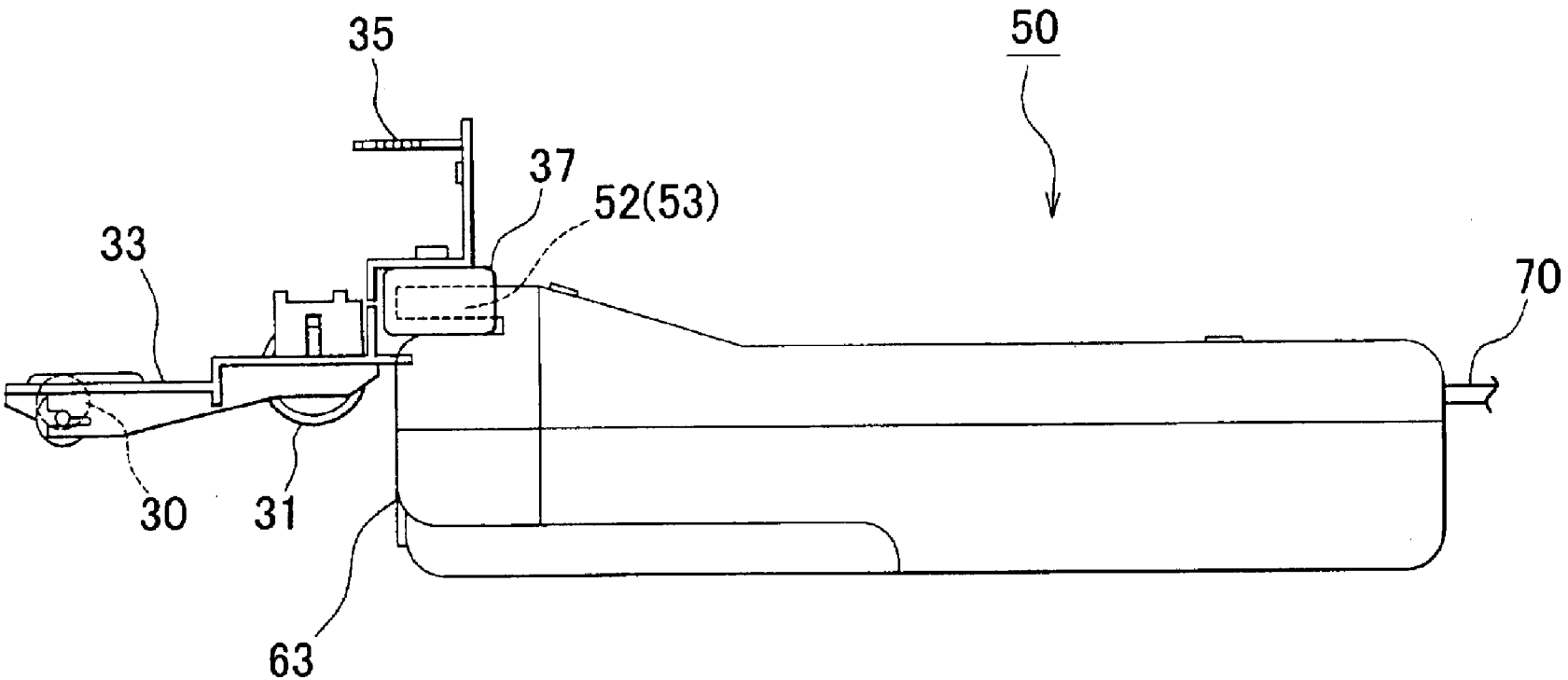
FIG. 3 is a cross-sectional view of a lower discharge frame and a positioning adapter included in the ink-jet printer according to the present invention.
Figure 4A:
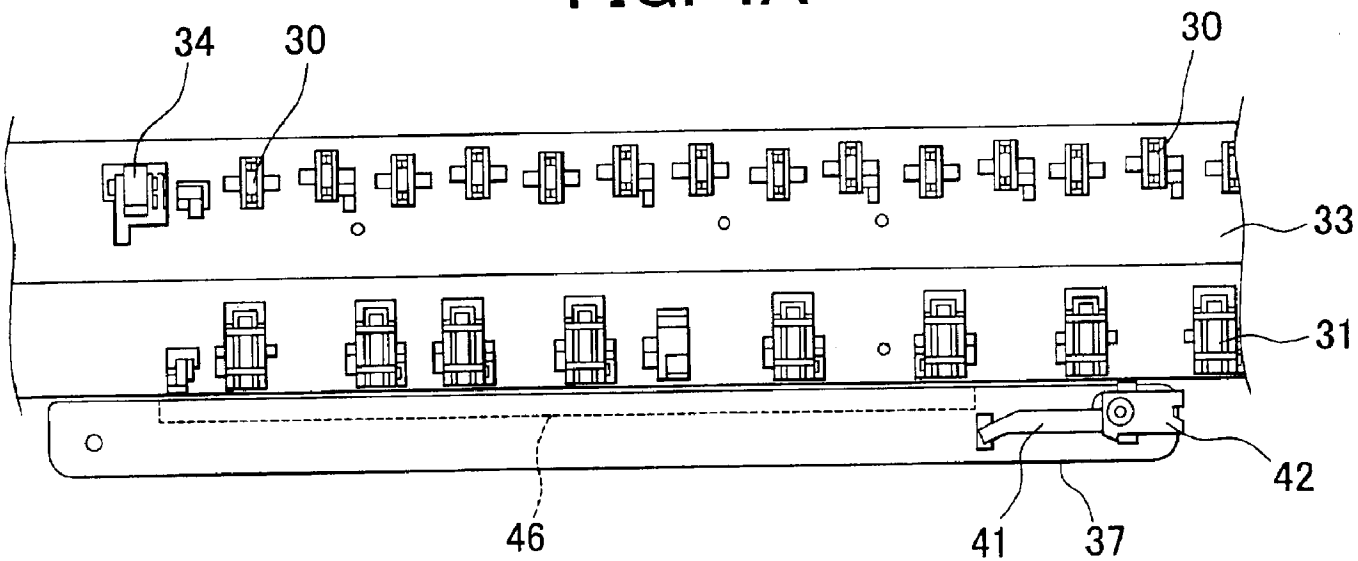
FIG. 4A is a plan view of an adapter attachment portion included in the ink-jet printer according to the present invention.
Figure 4B:
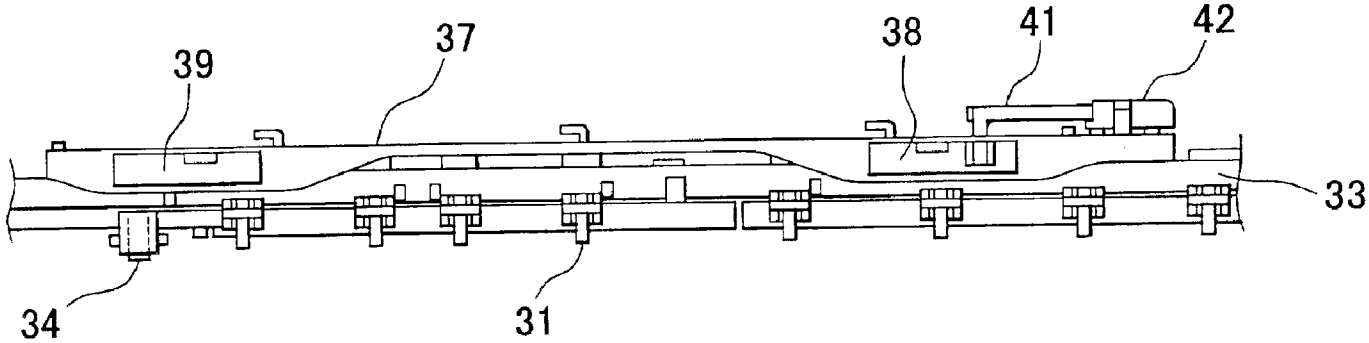
FIG. 4B is a front view thereof.
Figure 5A:
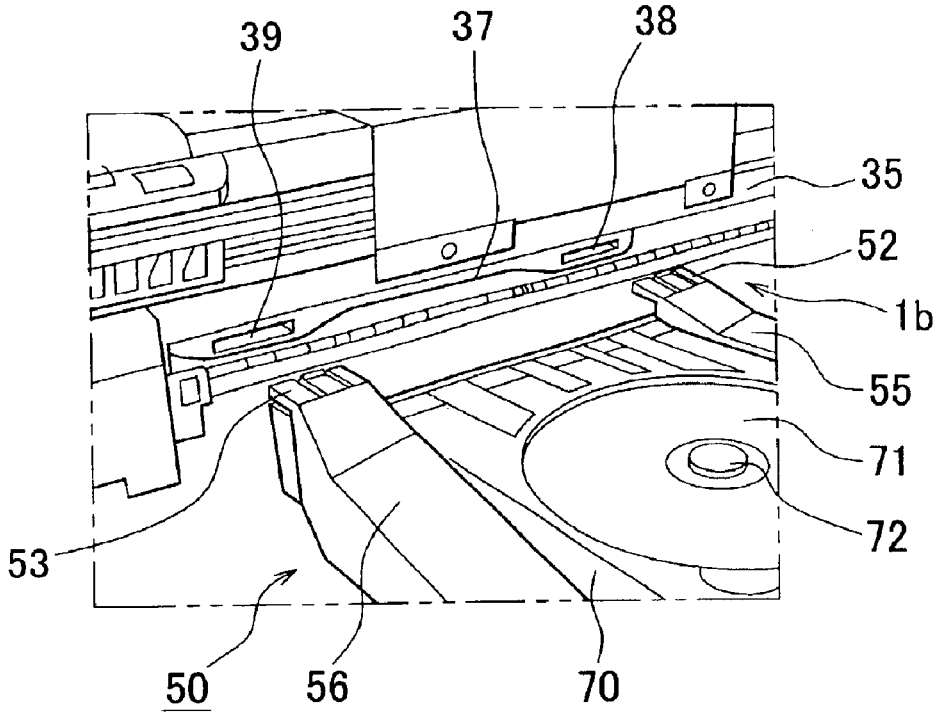
FIGS. 5A and 5B show an operation for attaching the positioning adapter to the adapter attachment portion in the ink-jet printer according to the present invention.
Figure 5B:
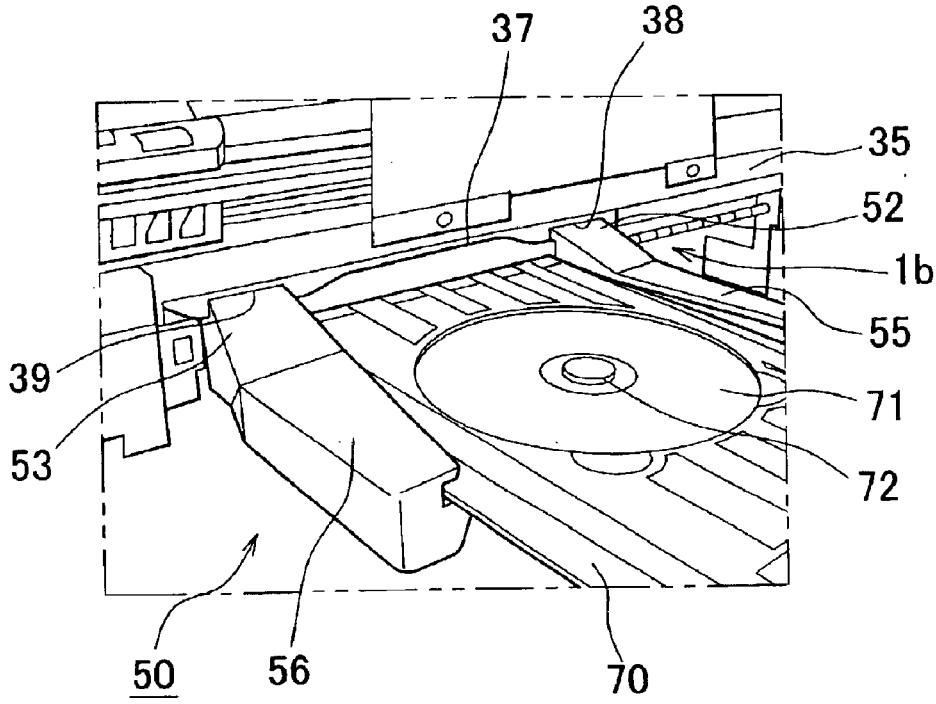
Figure 6:
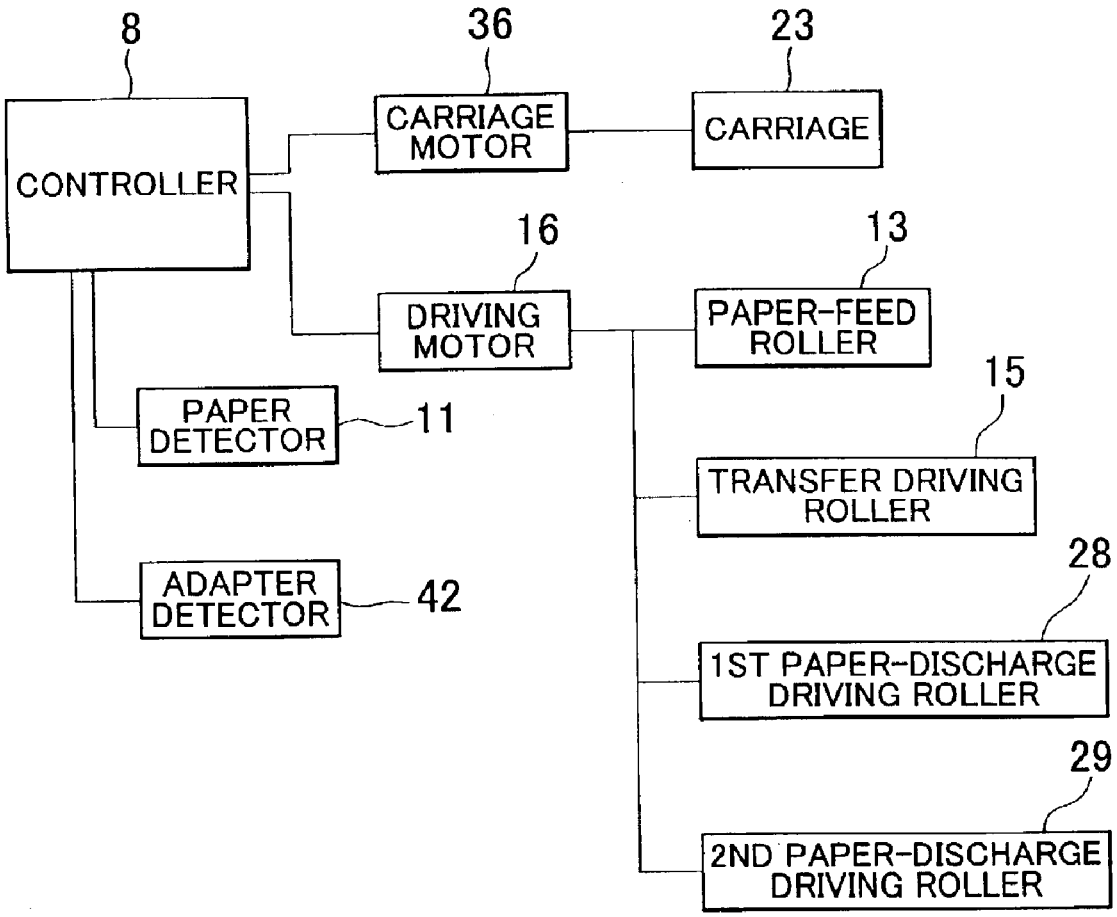
FIG. 6 is a block diagram of a control system in the ink-jet printer according to the present invention.

Referring to FIGS. 1–6, the structure of the ink-jet type recording apparatus according to an embodiment of the liquid emitting apparatus of the present invention (hereinafter, simply referred to as "printer") 1 is briefly described. FIG. 1 is a perspective view showing the appearance of the printer 1 (an outer cover of the printer 1 is removed); FIG. 2 is a cross-sectional view of the printer 1 in which the printer 1 is seen from the side thereof; FIG. 3 is a side view of a lower discharge frame 33 and an adapter 50; FIGS. 4A and 4B are plan and front views of an adapter attachment portion 37, respectively; FIGS. 5A and 5B show a process for attaching the adapter 50 to the adapter attachment portion 37; and FIG. 6 is a block diagram showing a control system in the printer 1. In the following description, the backside of the printer 1 (left side in FIG. 2) is referred to as an upstream side (upstream in a transfer path in which the recording medium is transferred), while the front side of the printer 1 (right side in FIG. 2) is referred to as a downstream side (downstream in the transfer path).

The printer 1 includes a paper feeder 5 in the backside thereof, as shown in FIG. 1. The paper feeder 5 feeds cut paper which is discharged via a paper exit 1*b* located on the front side of the printer 1. Further, the printer 1 is arranged to allow a recording-medium carrying tray (hereinafter, simply referred to as "tray") 70 in form of plate on which an optical disk such as a compact disc (not shown) can be placed, to be manually inserted into the printer 1 from the front side of the printer 1, thereby performing the printing operation directly onto a labeled surface of the optical disk. After the printing operation, the optical disk on the tray 70 is discharged from the front side of the printer 1. The tray 70 is supported by a positioning adapter (hereinafter, simply referred to as an "adapter") 50 which is attached to the paper exit 1*b* in such a manner that the adapter 50 can be removed or attached, from beneath the tray 70, thereby the position of the medium in the column direction (the width direction) when the tray 70 is fed into the printer 1 and is discharged out of the printer 1 can be determined. Please note that the width direction is the direction perpendicular to the direction along which the medium is transferred.

More specifically, the printer 1 includes the first, second and third feeding paths, as shown in FIG. 2. On the first feeding path, a sheet of cut paper P, that is placed on the paper feeder 5 at an angle with respect to the body of the printer 1, is transferred toward a direction shown with Arrow 1 by a paper-feeding roller 13 that is driven to rotate. On the second feeding path, a recording medium that is fed from the backside of the printer 1 is transferred to a position under an ink-jet recording head (hereinafter, simply referred to as a "recording head") 21 after passing under the paper feeder 5 in a substantially horizontal direction (shown with Arrow 2). On the third feeding path, a recording medium that is manually inserted from the front side (the right side in FIG. 2) of the printer 1 is transferred to the position under the recording head 21 in a substantially horizontal direction (shown with Arrow 3). The first feeding path is used for cut paper P having flexibility; the second feeding path is used for a rigid and thick recording medium (with no flexibility) such as board; and the third feeding path is used for the aforementioned tray 70. Moreover, a roll-paper holder (not shown) can be attached and removed to/from the paper feeder 5. The printer 1 has a further feeding path on which roll paper drawn out from the roll-paper holder is transferred to the position under the recording head 21 via passing under the paper feeder 5.

In the following description, the term "recording medium" is used as a generic term referring to a medium onto which the printing is done by ink drops emitted from the recording head 21, such as the cut paper, board, and optical disk mentioned above. Moreover, the term "transferred medium" is used for referring to a medium that is being transferred in any of the aforementioned feeding paths in the printer 1, such as the tray 70 mentioned above.

Next, components constituting the feeding paths in the printer 1 are described, referring mainly to FIG. 2. The paper feeder 5 includes a hopper 9 formed by a plate at an angle with respect to the body of the printer 1. The hopper 9 is arranged to be pivotable around a pivot center 9*a* provided at the upper part of the hopper 9 in a clockwise direction and a counterclockwise direction in FIG. 2. When a cam mechanism causes the hopper 9 to pivot in the counterclockwise direction in FIG. 2, the lower part of the hopper 9 is brought into contact with the paper-feeding roller 13 to push the paper-feeding roller 13, thereby feeding the uppermost one of sheets of the cut paper P stacked on the hopper 9 toward the downstream side of the printer 1 by rotation of the paper-feeding roller 13. Also, when the hopper 9 is caused to pivot in the clockwise direction in FIG. 2, the lower part of the hopper 9 is moved away from the paper-feeding roller 13. The paper-feeding roller 13 has a approximately D-shape in cross section and is driven to rotate by a driving motor 16 (see FIG. 6) described later. The outer circumference of the paper-feeding roller 13 is surrounded with rubber material (not shown), thus the sheet of cut paper P pushed toward the paper-feeding roller 13 can be transferred without being slipped. In addition, as shown in FIG. 2, the paper-feeding roller 13 is controlled in such a manner that a flat surface of the roller 13 faces the cut paper P while the transfer roller 19, provided on the downstream side of the paper-feeding roller 13 in the feeding path, is transferring paper precisely (i.e., during paper advance in the scanning direction), thereby preventing back tension.

The transfer roller 19 includes by a transfer-driving roller 15 that is driven to rotate by the driving motor 16 (see FIG. 6) detailed later and a transfer-driven roller 17 that can be in contact with the transfer-driving roller 15 so as to be rotated by the transfer-driving roller 15. The transfer-driving roller 15 extends in the main scanning direction (the direction perpendicular to the sheet surface of FIG. 2) along an axis. The transfer-driving roller 15 has a high-friction layer (not shown) formed of wear-resistant particles (for example, ceramic particles) fixed onto the outer circumference surface thereof by adhesive, so that it can precisely transfer the transferred medium without fail, preventing slip between the roller 15 and the back surface (the surface opposite to the surface for recording) of the transferred medium. On the other hand, a plurality of transfer-driven rollers 17 are arranged in the axis direction of the transfer-driving roller 15 and are supported at their axis-ends by roller holders 18 that are also arranged in the axis direction of the transfer-driving roller 15. The roller holders 18 support the transfer-driven rollers 17 at downstream ends of the roller holders 18 so as to allow the rollers 17 to rotate freely. In the present embodiment, one roller holder 18 supports two transfer-driven rollers 17.

The roller holders 18 are provided to be pivotable around a pivot center 18*a* in the clockwise direction and the counter-clockwise direction in FIG. 2, and a force is applied by a biasing mechanism (not shown) to the roller holders 18 in such a manner that the transfer-driven rollers 17 are pressed against the transfer-driving roller 15 (the clockwise direction in FIG. 2). Moreover, the roller holders 18 can be pivoted by rotation by a cam (not shown) in such a direction that the transfer-driven rollers 17 move away from the transfer-driving roller 15 (the counter-clockwise direction in FIG. 2). When the roller holders 18 are pivoted to move the transfer-driven rollers 17 away from the transfer-driving roller 15, the feeding path in a case of manually feeding the medium in the direction shown with Arrow 2 and that in a case of manually feeding the direction shown with Arrow 3 become open.

One of the roller holders 18 arranged along the axial direction of the transfer-driving roller 1, which is located at the closest end to column 0 (right side of the printer 1 when the printer 1 is seen from the front thereof; the backside of the sheet of FIG. 2) has a hole through which a paper-detection lever 14 is provided so as to project downward. The paper-detection lever 14 is pivotable around at its top end as the pivot center, so that the lever 14 is elevated upward when top end of the transferred medium fed in the direction shown with Arrow 1 or 2 passes through the lever 14 and moves back after the trail end of the transferred medium has passed. The pivot of the paper-detection lever 14 can be detected by a paper detector 11 (see FIG. 6). Upon detection of the paper, the paper detector 11 transmits a detection signal to a controller (see FIG. 6) of the printer 1, thereby detecting the passing of the transferred medium and the size (length in the direction along which the medium is transferred) of the transferred medium. A reference position of the recording medium in the width direction (the direction perpendicular to the sheet of drawing) is located at the column-0 end.

On the downstream of the transfer roller 19, an ink-jet type recording head (hereinafter, simply referred to as "recording head") 21 and a platen 25 are provided in such a manner that the platen 25 is opposed to the recording head 21. The recording head 21 is provided on the downstream of a carriage 23. Ink is supplied from an ink cartridge 24 placed on the carriage 23 to the recording head 21, so that the recording head 21 emits ink drops onto a recording surface of the recording medium. The carriage 23 is arranged to reciprocate in the main scanning direction (direction perpendicular to the sheet of FIG. 2) by a driving force generated by a carriage motor 36 (see FIG. 6) while being guided by a main carriage guide axis 22*a* and a sub-carriage guide axis 22*b* that are provided between a right side frame 6 and a left side frame 7 (see FIG. 1) that respectively stand the right and left sides of the body of the printer 1.

On the downstream of the recording head 21, an arrangement for discharging the medium onto which the ink drops were emitted is provided. The first discharge roller 26 is provided on the downstream of the recording head 21. Further, the second discharge roller 27 is provided on the downstream of the first discharge roller 26. The first and second discharge rollers 26 and 27 are formed by a pair of the first paper-discharge driving roller 28 and the first paper-discharge driven roller 30 and a pair of the second paper-discharge driving roller 29 and the second paper-discharge driven roller 31, respectively. The discharge-driving rollers 28 and 29 are driven to rotate by the driving motor 16 (see FIG. 6), while the discharge-driven rollers 29 and 31 are in resilient contact with the associated discharge-driving rollers 28 and 30 so as to be rotated by the associated discharge-driving rollers 28 and 30, respectively. The two pairs of rollers press the transferred medium and transfer it by rotating so that the transferred medium is discharged to the downstream side. The first paper-discharge driven roller 30 is formed by a toothed roller having teeth on its outer circumference that can be brought into point-contact with the recording surface of the recording medium, while the second paper-discharge driven roller 31 is formed by a rubber roller that can be brought into face-contact with the recording surface of the recording medium. The details of the first and second paper-discharge driven rollers 30 and 31 are described later.

The first paper-discharge driving roller 28 and the first paper-discharge driven roller 30 correspond to "discharge-driving roller" and "discharge-driven roller" recited in the claims, respectively. Also, the second discharge roller 27, the second paper-discharge driving roller 29 and the second paper-discharge driven roller 31 correspond to "advance roller," "advance-driving roller," and "advance-driven roller."

Both of the first paper-discharge driven rollers 30 and the second paper-discharge driven rollers 31 are arranged in the main scanning direction at predetermined intervals (see FIG. 4A) and are attached to a lower discharge frame 33 in form of elongate plate that extends in the main scanning direction. The lower discharge frame 33 is held at left and right ends by the left and right side frames 7 and 6 (see FIG. 1), respectively, and is pivotable by means of a holding portion detailed later, around an axis positioned on the downstream of the lower discharge frame 33 so as to move the upstream end thereof upward. By the pivot of the lower discharge frame 33, each first paper-discharge driven roller 30 can be moved between a non-contact position at which it is away from the first paper-discharge driving roller 28 and a contact position where the first paper-discharge driven roller 30 is in contact with the first paper-discharge driving roller 28. In other words, the lower discharge frame 33 is allows to have a "release posture" in which the first paper-discharge driven rollers 30 are away from the first paper-discharge driving roller 28 and a "contact posture" in which the driven rollers 30 are in contact with the associated driving roller 28. The details of the portion for changing the posture of the lower discharge frame 33 is described later.

As described above, when the first paper-discharge driven rollers 30 are moved away from the first paper-discharge driving roller 28, the feeding paths when the medium is manually inserted and is then fed in the directions shown with Arrow 2 and 3 become open. Also, the first paper-discharge driven rollers 30 are positioned so as not to be in contact with the recording surface of the medium. The reason why the first paper-discharge driven rollers 30 are positioned not to be in contact with the recording surface of the medium is that an optical disk transferred while being placed on the tray 70 has a data storage area directly below the recording surface (labeled surface). Thus, if the first paper-discharge driven roller 30, that has teeth on the outer circumference thereof, is brought into strong contact with the recording surface, the data storage area may be damaged.

In the printer 1 of the present embodiment, the second paper-discharge driven roller 31 can be moved away from the second paper-discharge driving roller 29 by a roller release mechanism (not shown). Thus, it is possible to prevent the contact of the second paper-discharge driven roller 31 with the recording surface of the medium. This is because, in a case where the recording medium is an optical disk, it is hard for ink emitted onto the recording surface to penetrate into the recording surface (labeled surface) and therefore it takes a long time to dry the ink on the recording surface. If the second paper-discharge driven roller 31 is brought into contact with the recording surface having non-dried ink thereon, incomplete coloring or ink transfer may be caused. The details of the roller release mechanism for moving the second paper-discharge driven roller 31 away from the second paper-discharge driving roller 29 are described later.

In the present embodiment, the nip pressure applied to the recording medium between the first paper-discharge driven roller 30 and the first paper-discharge driving roller 28 and that applied between the second paper-discharge driven roller 31 and the second paper-discharge driving roller 29 are set in such a manner the former is larger than the latter (the former is 0.049 N (5 gf) and the latter is 0.147 N (15 gf), for example). This is because the first discharge roller 26 is positioned closer to the recording head 21 than the second discharge roller 27 and therefore some drops of the ink emitted from the recording head 21 may remain wet. If the large nip pressure is applied onto the recording surface of the medium with the wet ink drops thereon, ink transfer or the like may be caused, degrading the printing quality. Thus, the first and second discharge rollers 26 and 27 are arranged in such a manner that the second discharge roller 27 apply the larger nip pressure to the recording medium than the first discharge roller 26 in the present embodiment. This enables high-precision transfer of the transferred medium even after the trail end of the medium passes through the transfer roller 19.

Referring to FIG. 3, an upper discharge frame 35 is provided above the lower discharge frame 33. An adapter attachment portion 37 for attaching an adapter 50 thereto is provided at a position that is closer to the left side of the upper discharge frame 35 (see FIG. 1) seen from the front of the printer 1. The adapter attachment portion 37 has a right dent 38 and a left dent 39 at positions near its right and left ends, as shown in FIG. 4B. please Into these right and left dents 38 and 39 are inserted right and left protrusions 52 and 53 provided a top end (the left side in FIG. 3) of the adapter 50 so that the protrusions 52 and 53 fit into the corresponding dents 38 and 39, as shown in FIGS. 5A and 5B, thereby the adapter 50 is attached to the paper exit 1*b*.

In the right dent 38, a detection end 41 and a detect portion 42 are provided for detecting that the right protrusion 52 fits into the right dent 38. The detection end 41 is arranged in such a manner that one end thereof is held by the detection portion 42 so as to be pivotable around the end and the other end projects into the right dent 38. When the right protrusion 52 fits into the right dent 38, the detection end 41 is caused to pivot (in the clockwise direction in FIG. 4A), thereby causing the detection portion 42 to transmit a detection signal to the controller 8 of the printer 1 (see FIG. 6). In this manner, the controller 8 can detect that the adapter 50 was attached to the paper exit 1*b* of the printer 1 and can prevent the operation for transferring the medium from the upstream to the downstream while the adapter 50 is attached to the paper dent 1*b*. Therefore, it is possible to prevent a disadvantage, such as a jam caused by interference between the transferred medium traveling toward the adapter 50 and the adapter 50.

The adapter 50 further includes a right grip 55 and a left grip 56 on both sides thereof, as shown in FIGS. 5A and 5B. Between these grips 55 and 56, the tray 70 in form of plate is inserted. The tray 70, that is supported by the adapter 50 positioned under the tray 70, has a concave portion 71 in which an optical disk is placed and an projection 72 for fitting into a hole formed at the center of the optical disk when the optical disk is placed on the concave portion 71. Thus, the optical disk placed on the tray 70 is fixedly held by the tray 70. The position of the tray 70 in the column direction during the feeding of the recording medium is determined by the adapter 50. When the tray 70 was inserted into the adapter 50, a slidable range of the tray 70 in which the tray 70 can slide in forward and backward directions with respect to the adapter 50 can be regulated by an engagement mechanism (not shown). Thus, once the tray 70 was inserted into the adapter 50, the tray 70 hardly falls out of the adapter 50. In this manner, the adapter 50 and the tray 70 constitute a single unit, thus increasing operability of the adapter 50 and the tray 70.

In the above, the details of the feeding paths in the printer 1 were described. Next, the control system in the printer 1 is briefly described referring to FIG. 6. The printer 1 includes a controller 8 having a CPU, ROM, RAM, interface for connection with an external computer, motor driver and the like, that are not shown. The controller 8 receives as its input the detection signal from the paper-detector 11 and the detection signal from the detection portion 42 that indicates the adapter 50 was attached, and performs necessary controls based on these detection signals. The components to be controlled by the controller 8 include a carriage motor 36 for driving the carriage 23 and a driving motor 16 for driving a paper-feeding roller 13, a transfer-driving roller 15, the first paper-discharge driving roller 28, the second paper-discharge driving roller 29. The controller 8 controls driving timings, speeds of rotation and rotation amounts of the paper-feeding roller 13, transfer-driving roller 15, the first paper-discharge driving roller 28 and the second paper-discharge driving roller 29 in accordance with various control programs stored in the ROM of the controller 8.

The entire arrangement of the printer 1 was described in the above.

<2. Arrangement of the First Paper-discharge Driven Roller>

Figure 7A:
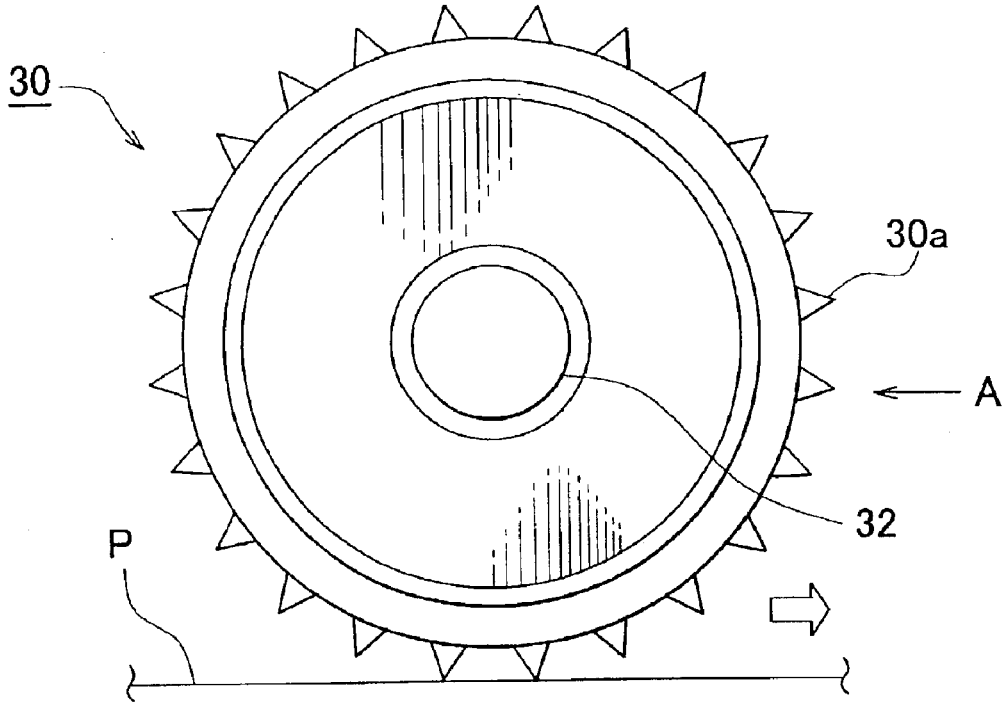
FIG. 7A is a plan view of the first paper-discharge driven roller included in the ink-jet printer according to the present invention.
Figure 7B:
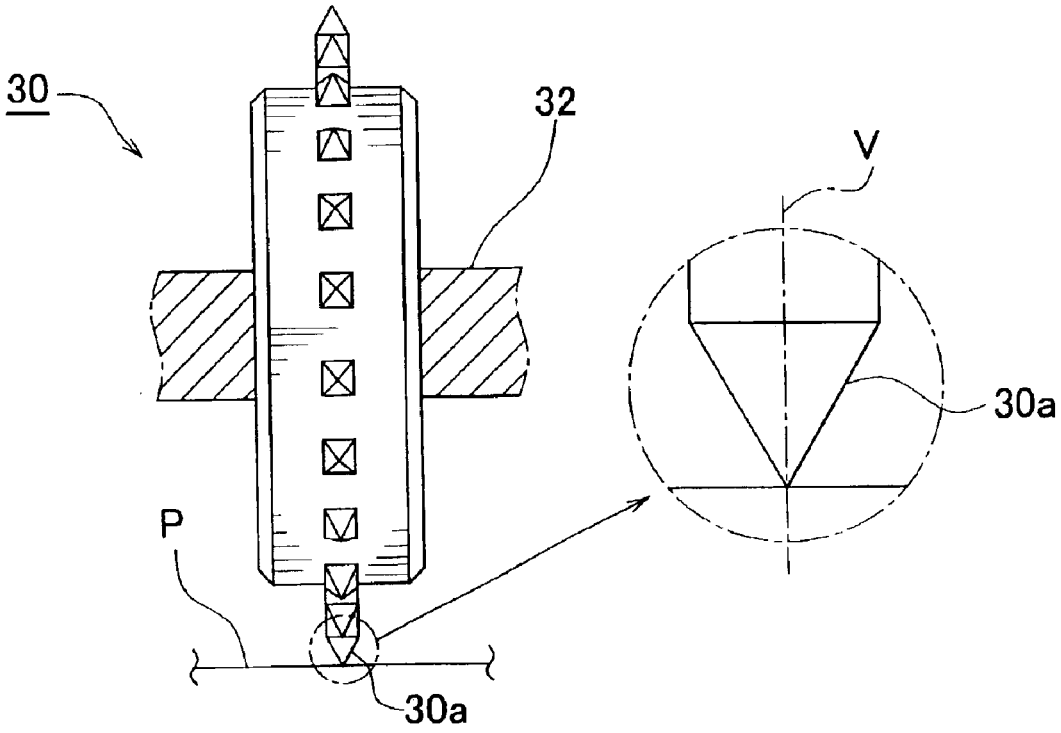
FIG. 7B is a front view thereof, seen from the direction shown with Arrow A.

Referring to FIGS. 7A, 7B, 8A, 8B, 8C and 8D, the detailed structure of the first paper-discharge driven roller 30 is described. Please note that cut paper P is referred to as an example of the recording medium for simplifying description. As shown in FIGS. 7A and 7B, a plurality of teeth 30*a* are provided at regular intervals on the outer circumference of the roller 30. The teeth 30*a* are brought into contact at points with the recording surface of cut paper P. The transfer of the cut paper P causes the first paper-discharge driven roller 30 to be rotated. A bar spring 32 is provided to be inserted through the center of the axis of the first paper-discharge driven roller 30, and is supported by a roller holder 43 (see FIG. 19) provided under the lower discharge frame 33. Thus, the first paper-discharge driven roller 30 is sprung toward the first paper-discharge driving roller 28.

Figure 8A:
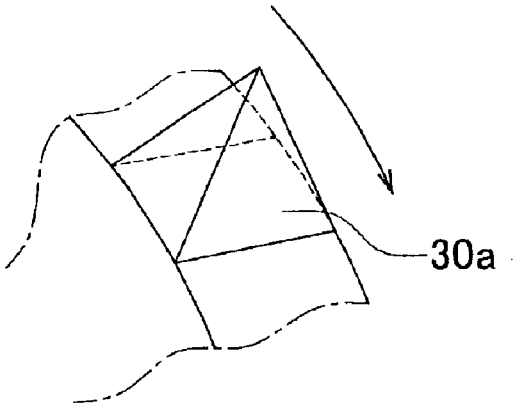
FIGS. 8A, 8B, 8C and 8D are perspective views of other examples of the first paper-discharge driven roller according to the present invention.

The tooth 30*a* is formed to have a symmetrical shape when being seen from the transferred direction of the cut paper P (direction shown with Arrow A in FIG. 7A), as shown in FIG. 7B. More specifically, each tooth 30*a* is formed to be a square pyramid that tapers off towards a pointed top thereof, as shown in FIG. 8A. The cross section of the square pyramid is symmetrical with respect to a straight line V vertical to the recording surface of the cut paper P when the square pyramid is seen from the transferred direction of the cut paper P, as shown in FIG. 7B. Thus, even if the first paper-discharge driven roller 30 is rotated while it digs into the recording surface of the cut paper P with the teeth 30*a*, the first paper-discharge driven roller can be rotated with no distortion.

In a case where each tooth 30*a* has an asymmetrical shape with respect to the line V in FIG. 7B, (a cross-sectional shape where one side of the tooth 30*a* is perpendicular to the recording surface of the cut paper P while the other side is at an angle with respect to the recording surface, for example), a force is applied to the tooth 30*a* in a direction perpendicular to the transferred direction (horizontal direction in FIG. 7B) if the tooth 30*a* is embedded into the recording surface of the cut paper P. This causes distortion in the first paper-discharge driven roller 30 when the roller 30 is rotated. The rotation with distortion of the first paper-discharge driven roller 30 causes the tooth 30*a* to cut the recording surface of the cut paper P. In this case, it is easy to recognize the track of the first paper-discharge driven roller 30*a* on the recording surface of the cut paper P. Especially, in a case of pigmented ink, a layer of ink on the recording surface can be easily removed off because of low permeability of the ink for the recording surface, making the track of the roller 30 more visible.

The tooth 30*a* of the present embodiment is, however, formed to be symmetrical when being seen from the transferred direction of the cut paper P as described above. Therefore, the first paper-discharge driven roller 30 can be rotated with no distortion, minimizing the track of the roller 30. Especially, even in a case of high-quality printing using pigmented ink to achieve approximately the same quality as photograph, it is possible to prevent the printing quality from being degraded.

Figure 8B:
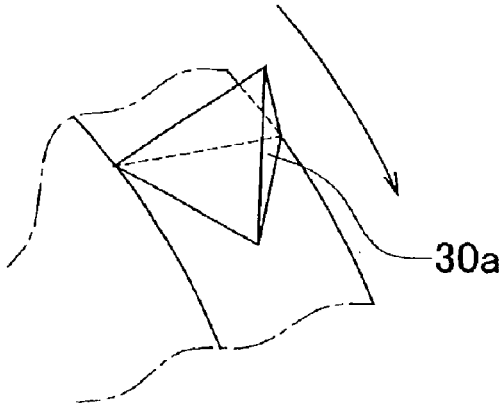
Figure 8C:
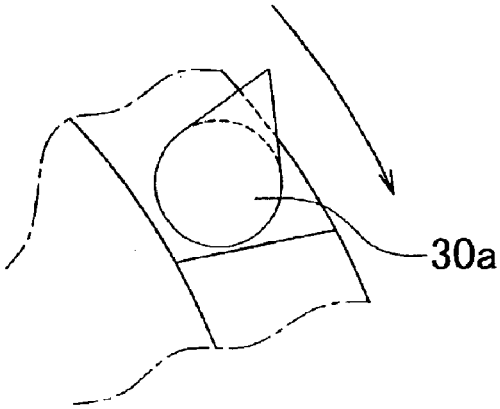
Figure 8D:
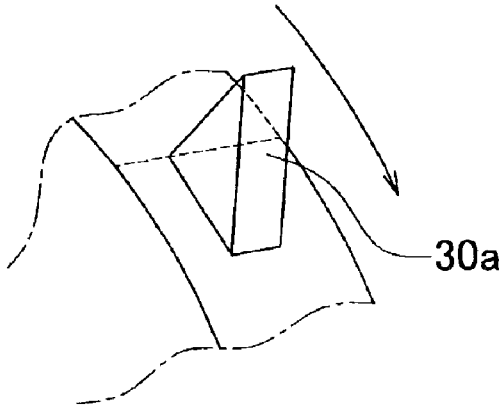

Other than the shape shown in FIG. 8A, the tooth 30*a* of the present embodiment has any of shapes shown in FIGS. 8B, 8C and 8D. FIG. 8B shows a tooth 30*a* having a shape of triangular pyramid; FIG. 8C shows a tooth 30*a* having a conical shape; and FIG. 8D shows a tooth 30*a* that is a triangle cross-section when being seen from the axial direction of the roller 30 and is a rectangle cross-section when being seen from the transferred direction of the cut paper P. The teeth 30*a* shown in FIGS. 8B, 8C and 8D are symmetrical when being seen from the transferred direction of the cut paper P, thereby allowing the rotation of the first paper-discharge driven roller 30 with no distortion. It should be noted that other shapes than the exemplary shapes shown in FIGS. 8A, 8B, 8C and 8D can be used.

<3. Arrangement of the Second Paper-discharge Driven Roller>

Figure 9A:
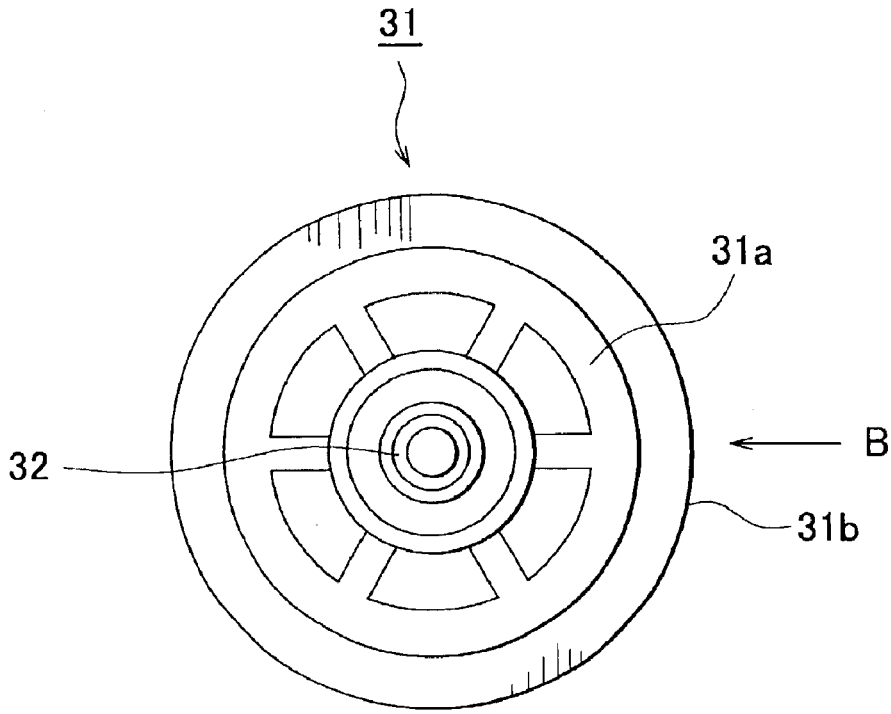
FIG. 9A is a plan view of the second paper-discharge driven roller included in the ink-jet printer according to the present invention.

Next, the detailed structure of the second paper-discharge driven roller 31 is described, referring to FIGS. 9A–15C. First, the appearance of the roller 31 is described referring to FIGS. 9A and 9B. FIG. 9A shows a perspective view of the second paper-discharge driven roller 31, while FIG. 9B shows a front view thereof (seen from the direction shown with Arrow B).

Figure 9B:
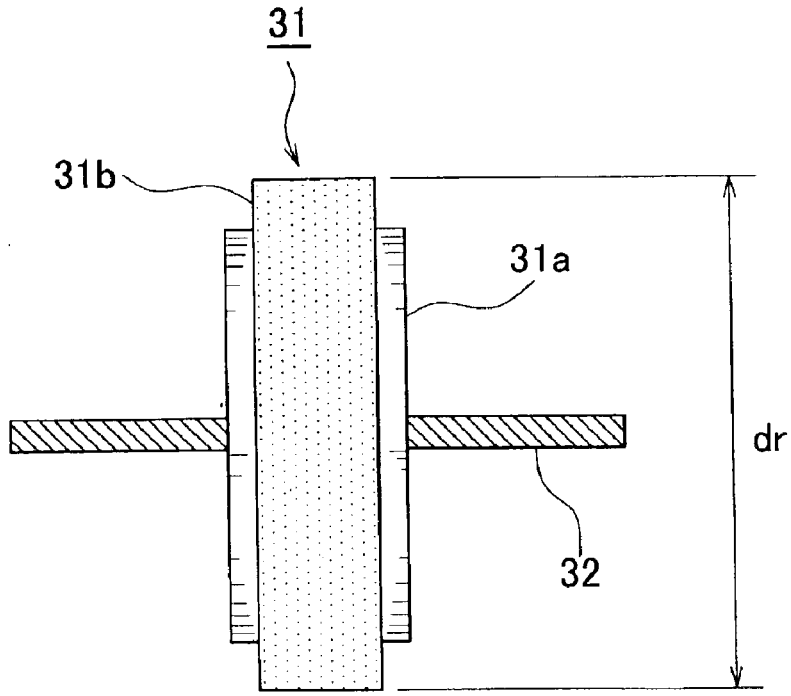
FIG. 9B is a front view thereof, seen from the direction shown with Arrow B.

The second paper-discharge driven roller 31 includes a wheel 31*a* formed of a resin with rubber material 31*b* of a doughnut shape (having a width of about 3 mm in the present embodiment) surrounding the wheel 31*a*, as shown in FIGS. 9A and 9B. Through the center of the axis of the wheel 31*a*, a bar spring 32, which is supported by the roller holder 43 (see FIG. 19), is inserted in a similar manner to that in the first discharge-driving roller 28 mentioned above, thereby springing the second paper-discharge driven roller 31 toward the second paper-discharge driving roller 29.

The outer circumference of the second paper-discharge driven roller 31 is processed (the depth of 20–100 $\mu$m in the present embodiment) in order to reduce the hardness of the outer circumference of the roller without reducing the hardness of the rubber material 31. The reason for reducing the hardness of the outer circumference of the roller is to increase the area of contact between the roller 31 and the cut paper P. The increased contact area leads to high-precision transfer of the cut paper P without fail. The reason why the hardness of the rubber material 31 is not reduced is that the lower hardness of the rubber material 31 has adverse effects on the printing surface of the cut paper P because of exuding plasticizer. In the present embodiment, the hardness of the outer circumference of the second paper-discharge driven roller 31 is 22 to 30 (JIS hardness).

For the rubber material 31, CM resin (chlorinated polyethylene resin) is used in the present embodiment. This is because the CM resin has property in which plasticizer contained therein is relatively hardly to exude even if the hardness of the CM resin is lowered. Therefore, the user of the CM resin also suppresses the exuding of the plasticizer, preventing the adverse effects on the printing surface.

Moreover, the outer circumference of the second paper-discharge driven roller 31 is subjected to ink-repellent finishing, thereby preventing color transfer of ink.

The second paper-discharge driven roller 31 is formed to have a larger diameter dr than that of the first paper-discharge driven roller 30, as is apparent from FIG. 2 (dr=15 mm in the present embodiment). Next, advantageous effects of designing the second paper-discharge driven roller 31 to have a larger diameter dr than that of the first paper-discharge driven roller 30 are described in detail referring to FIGS. 10A to 15C.

Figure 10B:
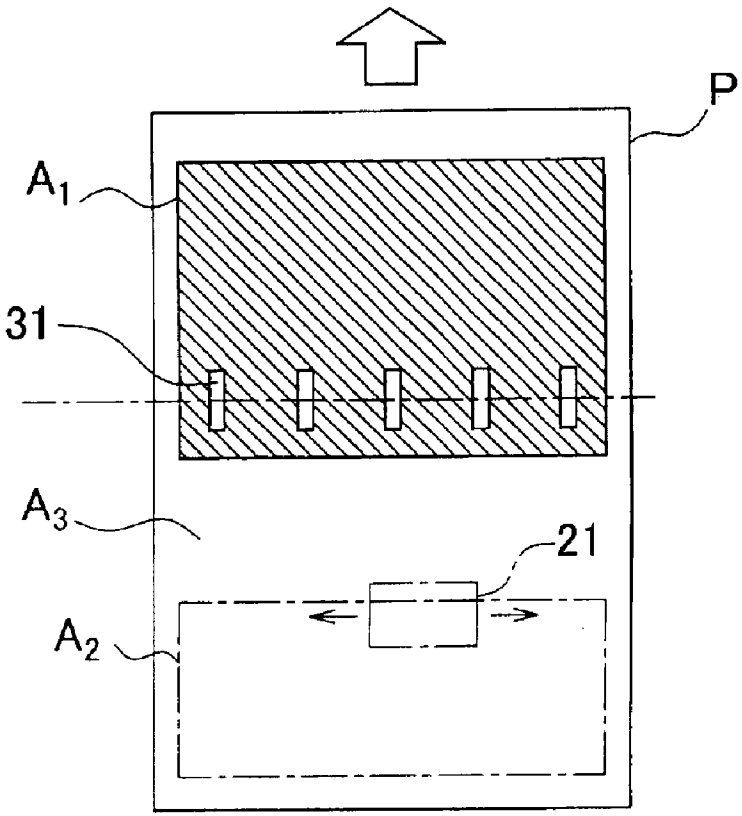
FIGS. 10A and 10B illustrate states of cut paper P passing through the second paper-discharge driven roller.
Figure 10A:
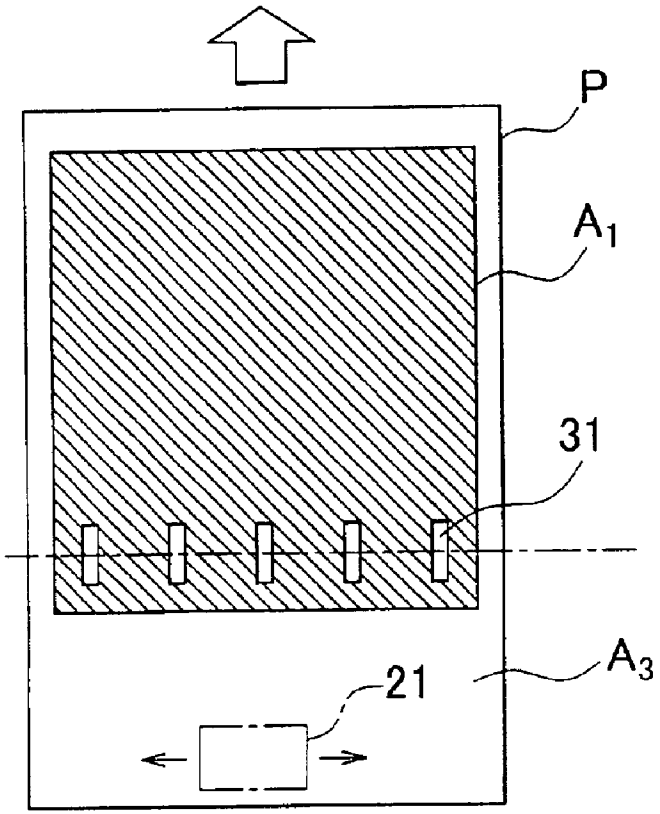

FIGS. 10A and 10B show states where a sheet of cut paper P passes through the second paper-discharge driven rollers 31 arranged in the column direction, toward the direction shown with an arrow. In FIGS. 10A and 10B, a region $A_1$ is a printing region onto which ink was emitted by the recording head 21 (region for which printing with high ink-duty, such as a high-quality photo-printing was performed, for example); and a region $A_2$ is a printing region onto which ink will be emitted.

As described above, the second paper-discharge driven roller 31 is formed by a rubber roller that is brought into face-contact with the cut paper P in order to transfer the cut paper P without fail. Thus, if the region of the cut paper P, for which high ink-duty printing was performed, passed through the second paper-discharge driven rollers 31, as shown in FIG. 10A, wet ink causes color transfer to the second paper-discharge driven rollers 31 and the transferred ink may be further transferred onto the recording surface of the cut paper P after one revolution of the second paper-discharge driven roller 31, degrading the printing quality. Such transfer of ink occurs not only in the printing region $A_1$ but also in a margin $A_3$ that passes through the second paper-discharge driven roller 31 after the printing region $A_1$. The ink transfer in the margin $A_3$ is more visible, leading to undesirable printing quality.

Figure 11:
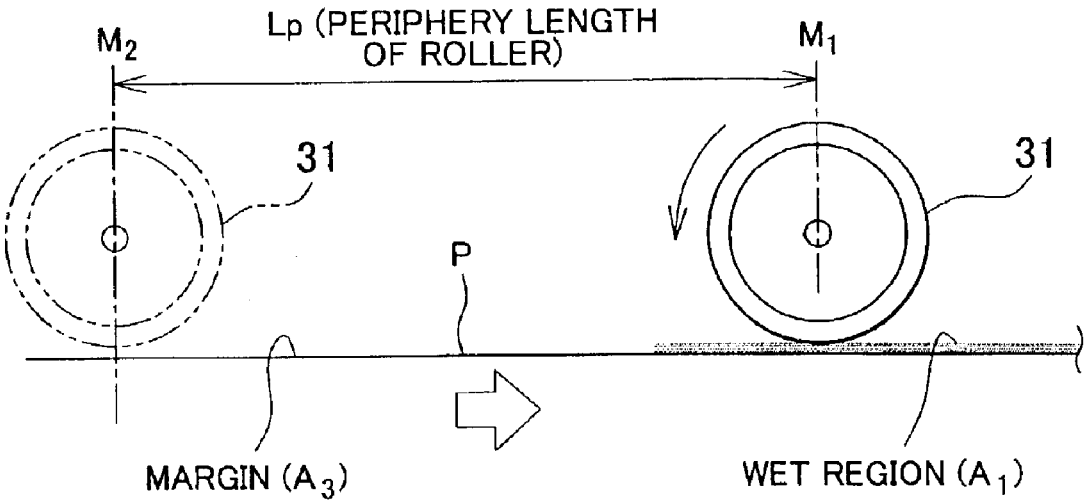
FIG. 11 illustrates a relationship between the outer diameter of the second paper-discharge driven roller and ink transfer.

In order to prevent the aforementioned disadvantage, in the printer 1 of the present embodiment, the second paper-discharge driven roller 31 is designed to have a larger outer diameter dr than that of the first paper-discharge driven roller so as to make the time required for one revolution of the second paper-discharge driven roller 31 longer, thereby ensuring the time required for fixing the ink transferred onto the outer circumference of the second paper-discharge driven roller 31 to such a degree that the transferred ink is not further transferred to the recording surface after one revolution of the second paper-discharge driven roller 31. This concept is shown in FIG. 11. The diameter dr of the outer circumference of the second paper-discharge driven roller 31, i.e., the periphery length $L_p$ of the roller 31 is set so that ink that was transferred onto the outer circumference of the second paper-discharge driven roller 31 at a position $M_1$ (in the region $A_1$ in FIG. 10A) in an ink-wet region will be fixed onto the outer circumference of the roller 31 to such a degree that the ink cannot be further transferred to the recording surface at a position $M_2$ (in the region $A_3$ in FIG. 10A) corresponding to a position at which the roller 31 arrives after the roller 31 is rotated by one revolution on the recording surface the cut paper P. Please note that an arrow in FIG. 11 indicates the transferred direction (discharge direction) of the cut paper P.

Next, how to determine the outer diameter dr of the second paper-discharge driven roller 31 is described in detail. In FIGS. 10A and 10B, the printer 1 alternately repeats an ink emitting step for emitting ink toward the cut paper P while the carriage 23 is being moved in the main scanning direction and a paper-advancing step for advancing the cut paper P in the sub-scanning direction by a predetermined length by driving the transfer roller 19 to rotate at a predetermined rotational speed. Since the rotational speed of the transfer motor 19 (the speed of paper advance) during the paper advance step and the length of paper advance per paper advance step are unique to the printer 1 and are therefore known, the time required for a single paper advance step can be obtained from those parameters. Although the speed of paper advance and the length of paper advance per paper advance step can be varied by printing modes, such as draft printing, high-quality character printing, image printing, interlaced image printing, the printer 1 of the present embodiment uses the most disadvantageous condition (corresponding to the shortest time of one revolution of the second paper-discharge driven roller 31). In the following, the speed of paper advance and the length of paper advance per single paper advance step in the most disadvantageous condition mentioned above are assumed to be Vc (mm/s) and Fp (mm), respectively. Thus, the time required for the single paper advance step, Tf (s) is given by Tf=Fp/V.

On the other hand, the time required for a single ink emitting step was expediently determined in advance. More specifically, the moved amount of the carriage 23 (the scanned range in the main scanning direction) is changed depending on printing data transmitted from a host computer (not shown), i.e., the size in the main scanning direction of the cut paper P or printing region. Thus, the moved amount of the carriage 23 is assumed to be an expedient value (constant value) Wp (mm) and the time required for one path of the carriage 23, i.e., the main scanning time is assumed to be Tp (s).

Then, the time required for fixing the ink transferred onto the second paper-discharge driven roller 31 to such a degree that the ink cannot be transferred to the recording surface, i.e., the ink fixing time Tc (s) can be determined experimentally by performing the high ink-duty printing for the recording surface and checking whether or not the transfer of ink onto the margin in the recording surface for each rotational speed of the transfer roller 19, i.e., the various speed of paper advance that is changed in a stepwise manner.

From the above, the paper advance step is repeated (Tc/(Tf+Tp)) times in the ink fixing time Tc, and therefore the cut paper P is advanced by (Tc/(Tf+Tp))×Fp (mm) in the ink fixing time Tc. Thus, this length is the minimum value required for the outer periphery length Lp of the second paper-discharge driven roller 31. In other words, Lp≧(Tc/(Tf+Tp))×Fp (mm).

It is desirable that the main scanning time Tp and the ink fixing time Tc be set smaller in order to prevent the ink transfer to the recording surface without fail. Thus, if there is no limitation on the outer diameter dr of the second paper-discharge driven roller 31, it is desirable to determine the periphery length Lp of the roller 31 only considering the time required for one paper advance step, Tf, without considering the main scanning time Tp, i.e., the time corresponding to one path of the carriage 23. In addition, the ink fixing time Tc varies depending on a surrounding condition such as a surrounding temperature. Therefore, it is desirable to consider the surrounding condition. However, as the safety is improved, the outer diameter dr of the second paper-discharge driven roller 31 becomes larger, making it harder to include the second paper-discharge driven roller 31 in the printer 1. Thus, it is desirable to determine the ink fixing time Tc or the main scanning time Tp considering the printing mode (image printing mode) in which the aforementioned design for preventing the ink transfer is the most effective based on the most common surrounding condition (room temperature).

In this manner, the ink that was transferred onto the second paper-discharge driven roller 31 is fixed to the roller 31 to such a degree that the ink cannot be transferred to the recording surface, during one revolution of the second paper-discharge driven roller 31. Thus, it is possible to prevent the ink transfer without providing a waiting time between the paper advance step and the ink emitting step. In other words, the ink transfer can be prevented without lowering the printing throughput.

In order to prevent the ink transfer certainly, it is enough that the ink transferred onto the second paper-discharge driven roller 31 be fixed to the roller 31 during one revolution of the roller 31 to such a degree that the ink cannot be transferred to the recording surface under at least a certain condition. Therefore, even if an ink jet printer cannot prevent the aforementioned ink transfer under all conditions (paper type of cut paper P, surrounding condition, ink component, color and the like), the ink jet printer can be considered to achieve the same effects as those the printer 1 of the present embodiment, as long as the ink jet printer can prevent the ink transfer under the certain condition.

Figure 12:
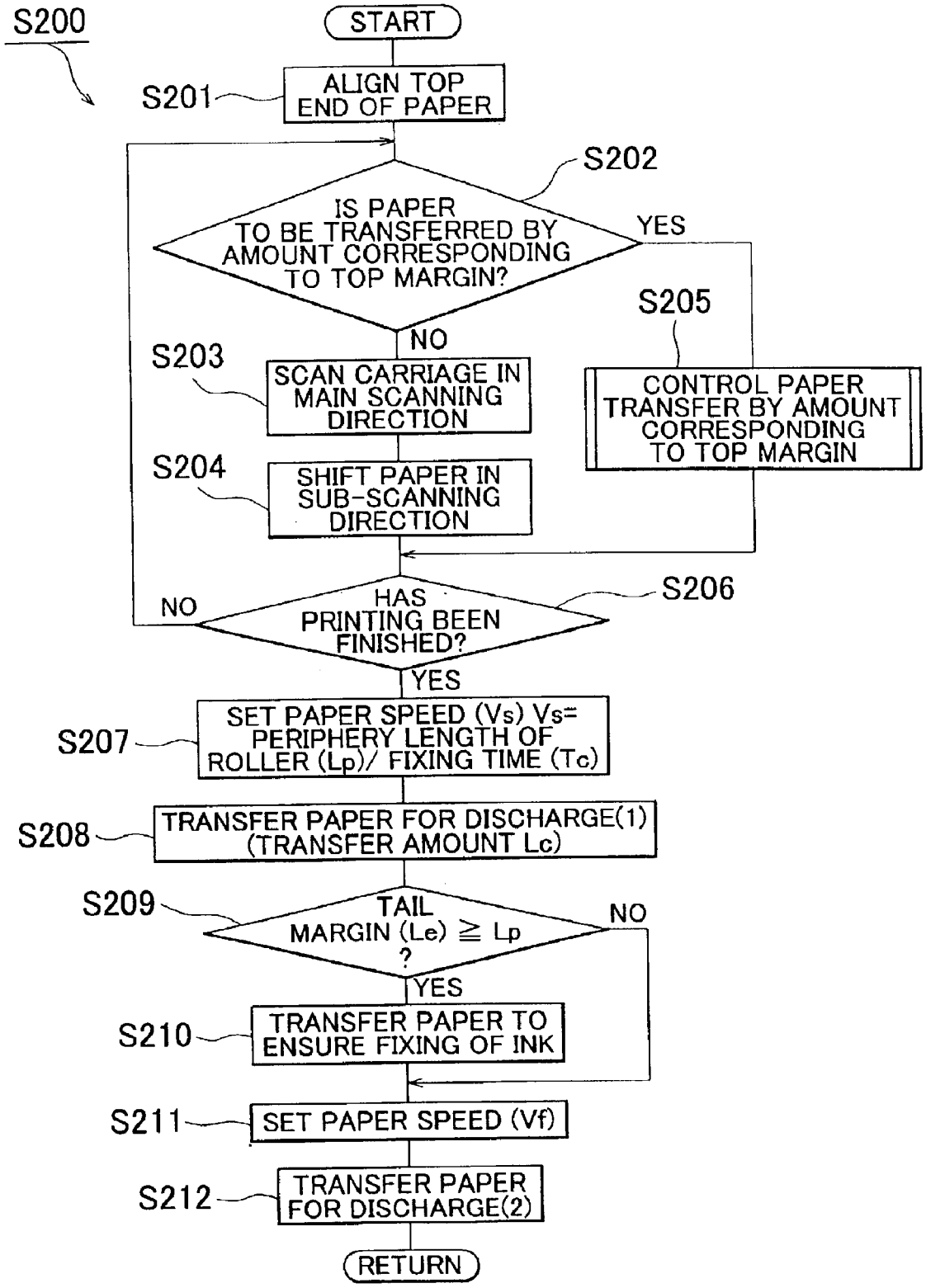
FIG. 12 is a flowchart of printing control in the ink-jet printer according to the present invention.
Figure 13:
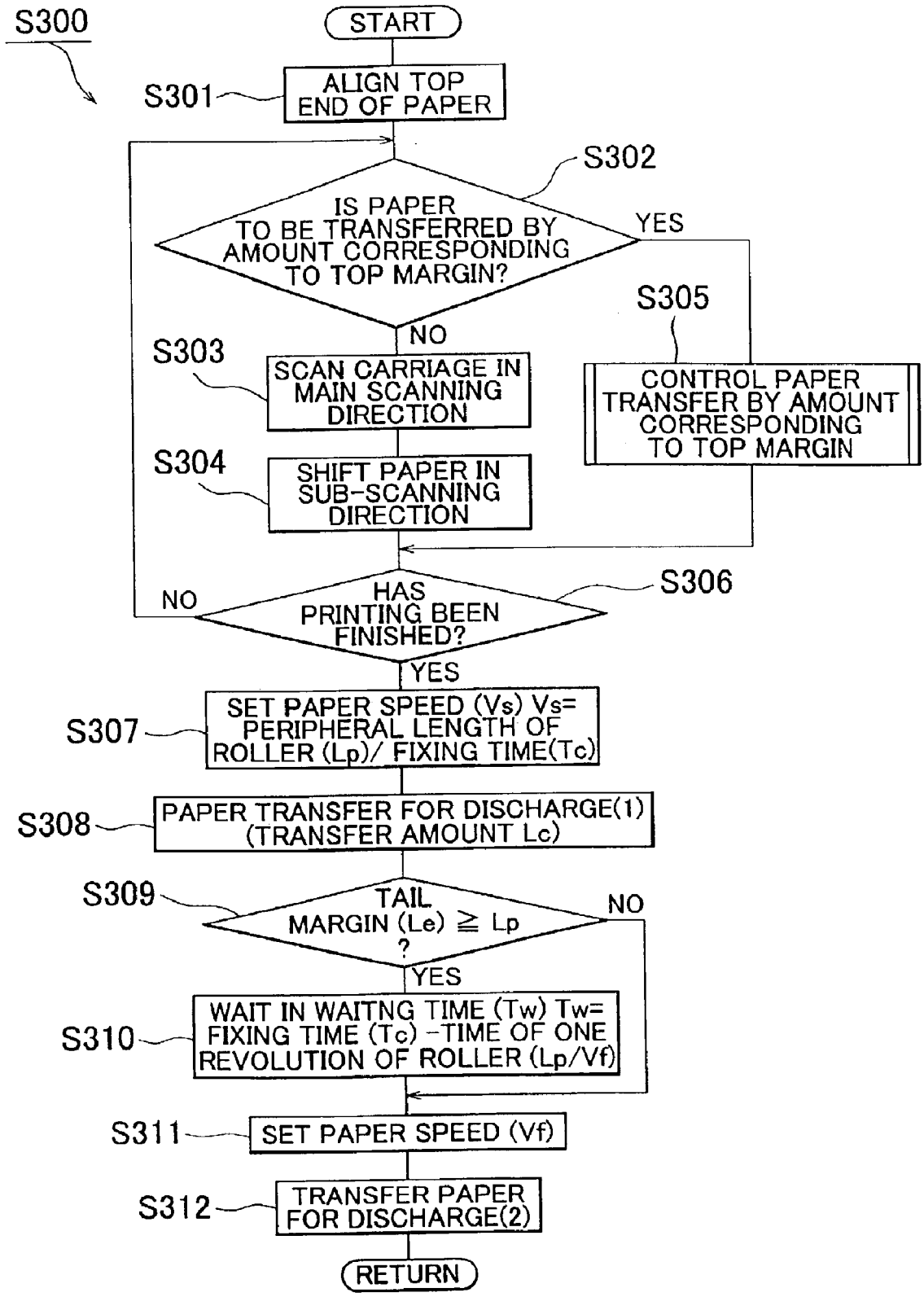
FIG. 13 is a flowchart of modification of the printing control of FIG. 12.
Figure 14:
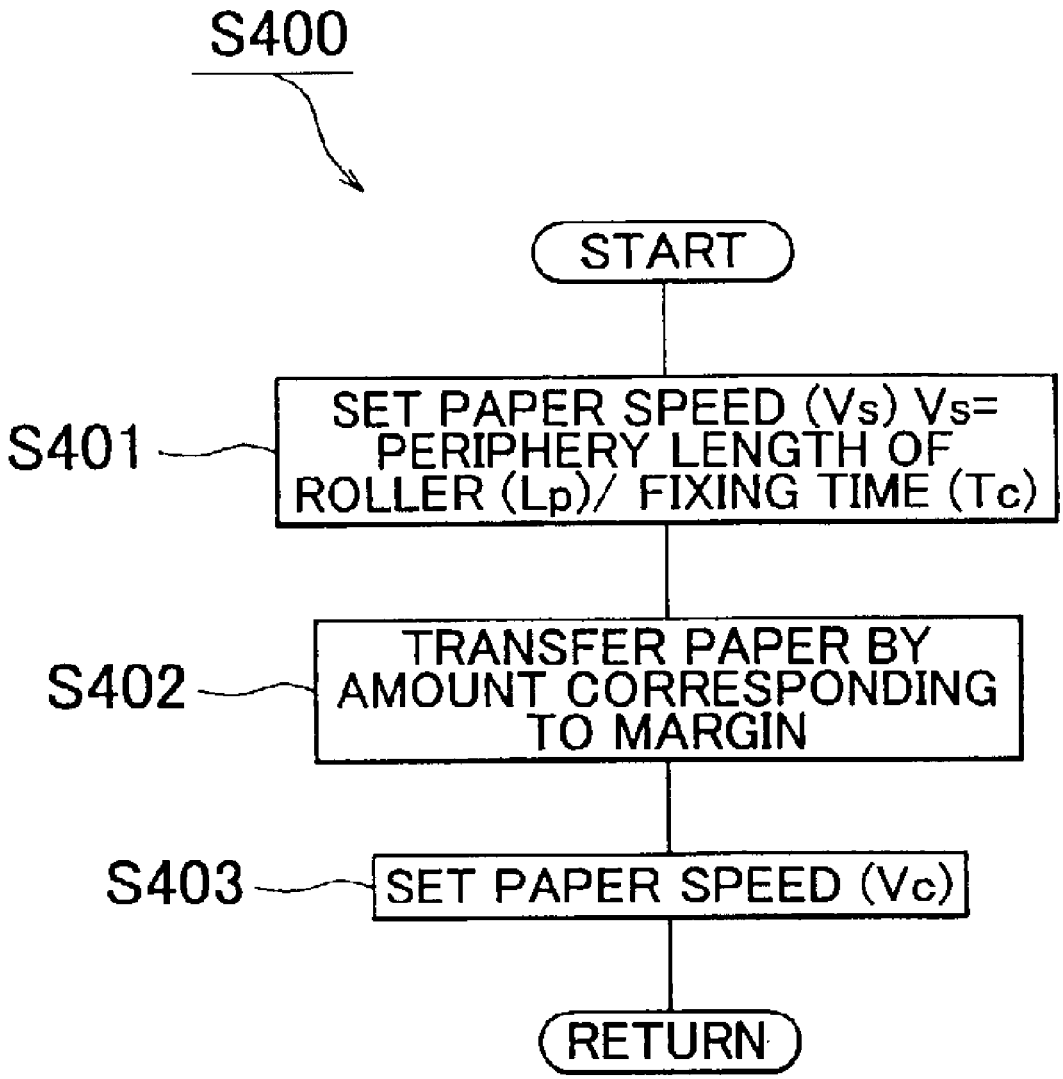
FIG. 14 is a flowchart of paper-advance control for margin in the ink-jet printer according to the present invention.
Figure 15A:
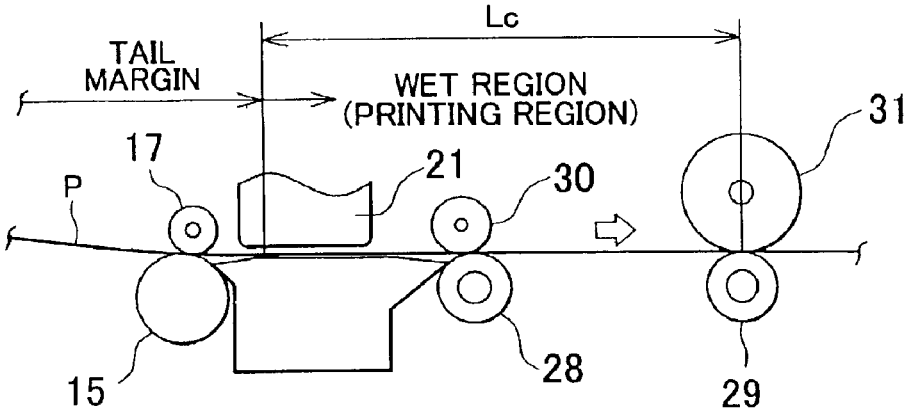
FIGS. 15A, 15B and 15C show states of cut paper P while the printing control of FIG. 12 is performed.
Figure 15B:
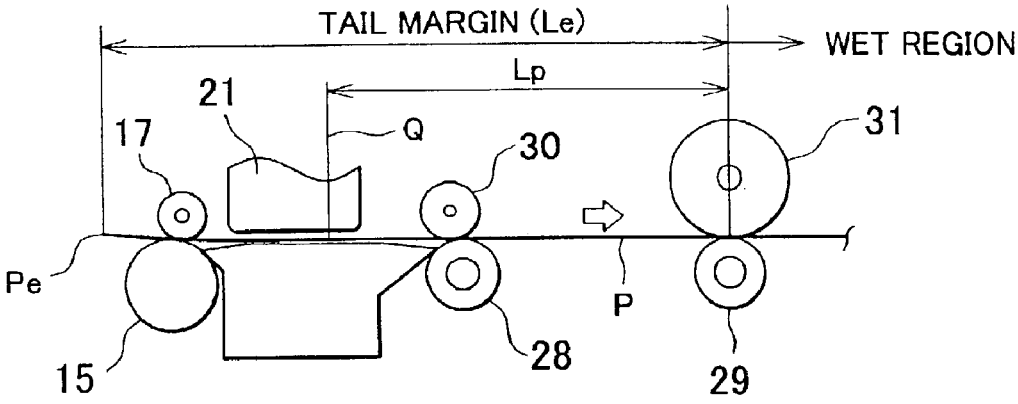
Figure 15C:
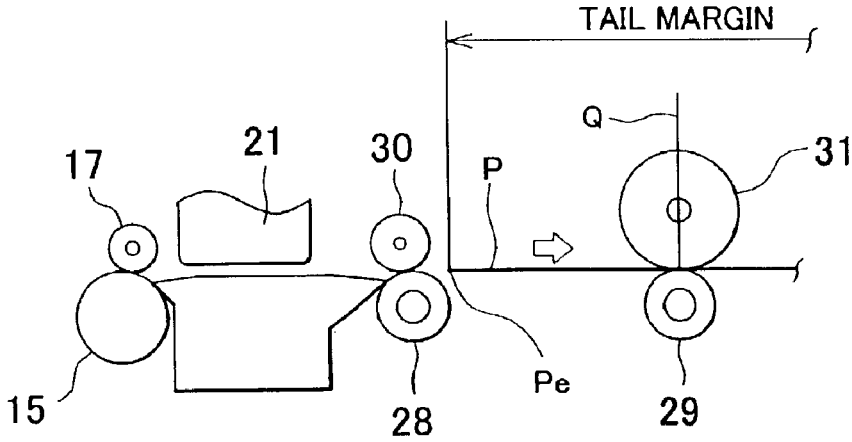

Next, a more specific controlling method in the printing operation is described with reference to FIGS. 12 to 15C. FIG. 12 is a flowchart showing the print control in the printer 1; FIG. 13 is a flowchart showing an alternative (another embodiment) of the print control shown in FIG. 12 and FIG. 14 is a flowchart showing a paper advance control by the length corresponding to a margin. FIGS. 15A, 15B and 15C show states of cut paper P during the printing control shown in FIG. 12. The printing controls shown in FIGS. 12 and 13 are stored in a storage device (not shown) as controlling programs, and are executed by the controller 8 (see FIG. 6).

In the control routine 200 shown in FIG. 12, alignment of a top end of paper is performed, that is, paper is advanced until a top end of the paper reaches a predetermined position (Step S201), and then the printing starts. During the printing operation, the scanning of the carriage 23 in the main scanning direction (ink emitting step) and the paper advance in the sub-scanning direction (paper advance step) are alternately repeated. In this case, the speed and length of paper advance are Vc (mm/s) and Fp (mm), respectively. Since the outer diameter dr of the second paper-discharge driven roller 31 is determined in accordance with the speed and length of paper advance, the ink transfer can be prevented.

In a case of transferring paper by the amount corresponding to the margin (when the printing operation for the printing region Al shown in FIG. 10B has been finished, for example), a paper-advance control for margin is performed in Step S205. This is because, if the paper advance step is performed repeatedly in order to leave the margin, the second paper-discharge driven roller 31 may be rotated by one revolution before the ink transferred onto the second paper-discharge driven roller 31 is sufficiently fixed onto the outer circumference of the roller 31.

In a routine 400 of the paper-advance control for margin shown in FIG. 14, the speed of paper advance is set to Vs (mm/s) (Step S401). The speed of paper advance Vs (mm/s) is obtained as the periphery length of the roller (Lp)/the ink fixing time (Tc), thereby ensuring the ink fixing time Tc. After the paper was transferred by the predetermined amount to leave the margin (Step S402), the speed of paper advance is set to Vc (mm/s) again and the flow goes back to the main routine.

Then, returning to FIG. 12, when the printing operation has been finished, i.e., when all emission of the ink has been finished (Yes in Step S206), the cut paper P is in a state shown in FIG. 15A, for example. In FIG. 15A, a region of the recording surface on the downstream of the recording head 21 (right side in FIG. 15A) is wet region having wet ink thereon (printing region), while a region of the recording surface on the upstream of the recording head 21 (left side in FIG. 15A) is a tail margin. Therefore, if the cut paper P is discharged at a high speed from the shown state, the ink transfer may be caused. In order to prevent the ink transfer, the speed of paper advance is set to the same value Vs as that during the paper-advance control for margin, in Step S207. At the speed Vs, the paper transfer (1) is performed until the trail end of the paper reaches the second paper-discharge driven roller 31 (shown in FIG. 15B) in Step S208. Please note that the length of paper advance in the paper transfer (1) is Lc (mm) and corresponds to a distance between closest nozzles of the recording head 21 to the transfer-driving roller 15 and the second paper-discharge driven roller 31 (see FIG. 15A). In FIGS. 15B and 15C, Pe represents the tail end of the cut paper P.

It is then determined whether or not the length Le (mm) of the trail margin in the transferred direction is larger than the periphery length Lp of the second paper-discharge driven roller 31 in Step S209. If the length Le of the trail margin in the transferred direction is smaller than the periphery length Lp of the roller 31 (No in Step S209), the speed of paper advance is set to Vf (higher speed) in Step S211 and then the paper transfer (2), that is the final transfer for discharging the paper, is performed in Step S212. On the other hand, if the length Le of the trail margin is larger than the periphery length Lp of the roller 31 (Yes in Step S209; shown in FIG. 15B), the ink transfer may be-caused. Thus, while the speed of paper advance is kept to a lower speed (Vs), the paper is transferred until the second paper-discharge driven roller 31 is rotated by one revolution (Step S210). This state is shown in FIG. 15C. In this manner, a position Q, corresponding to a position at which the second paper-discharge driven roller 31 arrives when the roller 31 is rotated toward the upstream side by one revolution in the state shown in FIG. 15B, moves to a position between the second paper-discharge driven roller 31.

Then, the speed of paper advance is set to Vf (higher speed) in Step S211, and the final paper transfer is performed so as discharge the cut paper P in Step S212. In this manner, even in a case where the trail margin of the cut paper P is large, the ink transfer can be prevented. After the possibility of ink transfer is eliminated (after the state shown in FIG. 15C), the paper is transferred at a higher speed, thereby being discharged quickly.

In the above routine, the ink transfer is prevented by transferring the paper at a lower speed from the state shown in FIG. 15B. Alternatively, as shown in FIG. 13, a waiting time may be provided after the cut paper P is transferred to be placed in the state shown in FIG. 15B. In this case, the cut paper P is discharged at a higher speed after the waiting time has passed. The flow shown in FIG. 13 is more specifically described. Steps S301 to S309 are the same as the corresponding steps in FIG. 12. Then, if the length Le of the trail margin in the transferred direction was determined to be larger than the periphery length Lp of the roller 31, the controller 8 waits in the waiting time Tw in Step S310 and then sets the speed of paper advance to Vf (higher speed) in Step S311. Then, the final paper transfer is performed at the speed Vf to discharge the cut paper P. Please note that the waiting time Tw is determined by subtracting a time required for one revolution of the second paper-discharge driven roller 31 with the speed of paper advance of Vf (Lp/Vf) from the ink fixing time Tc. Thus, even if the paper is transferred at a higher speed, the time required for one revolution of the second paper-discharge driven roller 31 is equal to the ink fixing time Tc. Therefore, it is possible to prevent the ink transfer.

It should be noted that the aforementioned print control is an example. One skilled in the art would appreciate that any controlling method can be used as long as the time required for one revolution of the second paper-discharge driven roller 31 is equal to or larger than the ink fixing time Tc.

<4. Attachment of the Discharge Frame>

Figure 16A:
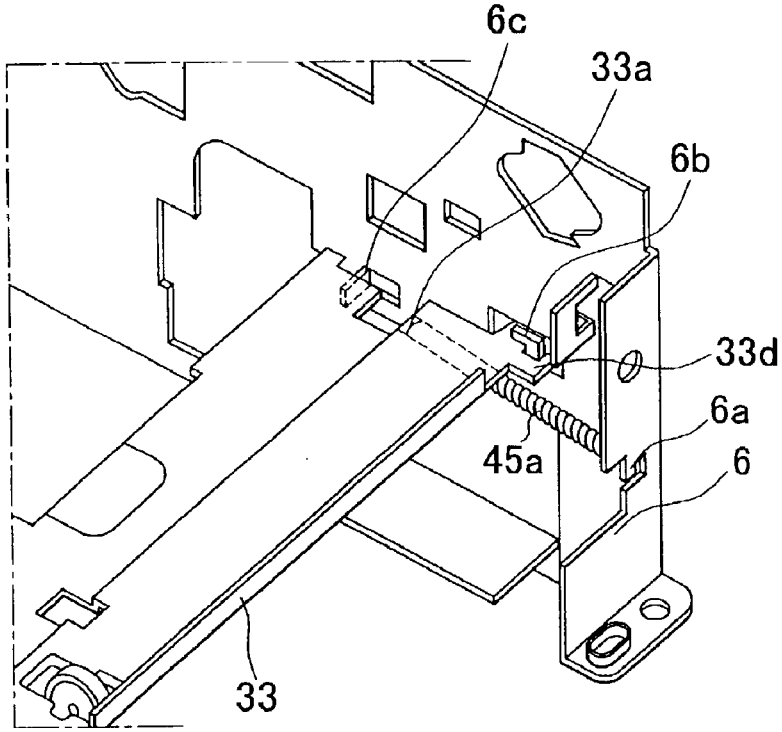
FIG. 16A is a perspective view of a right end of a lower discharge-frame in the ink-jet printer according to the present invention.
Figure 16B:
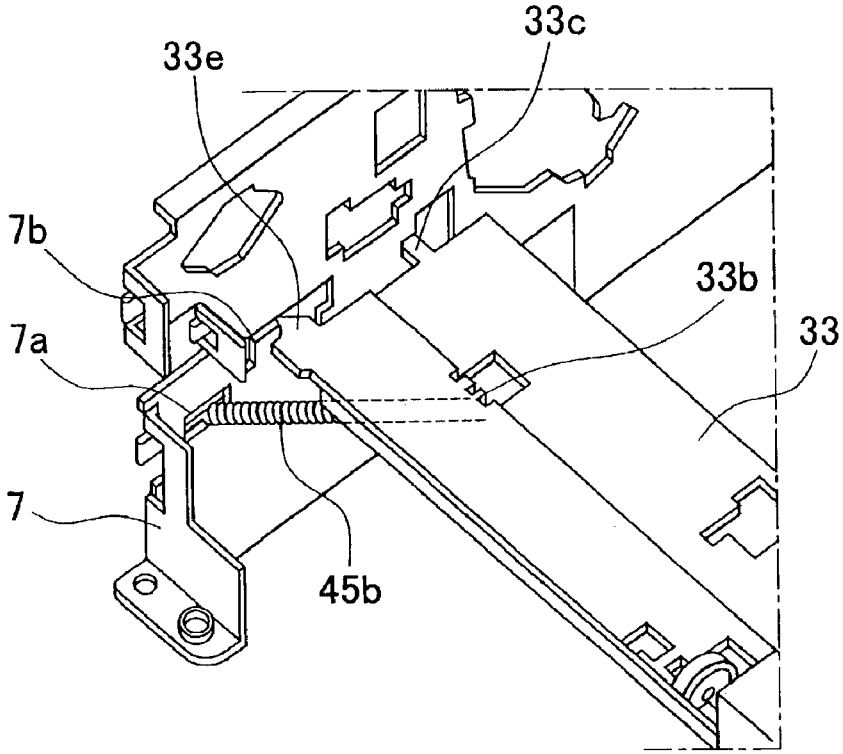
FIG. 16B is a perspective view of a left end thereof.
Figure 17:
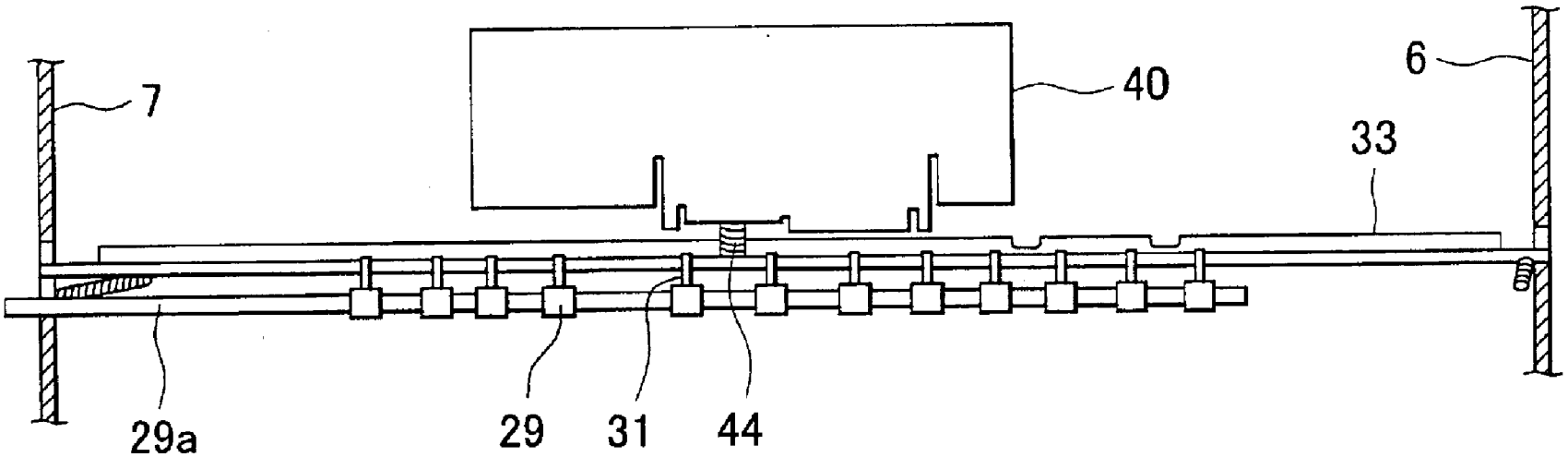
FIG. 17 is a front view of the lower discharge frame in the ink-jet printer according to the present invention.
Figure 18:
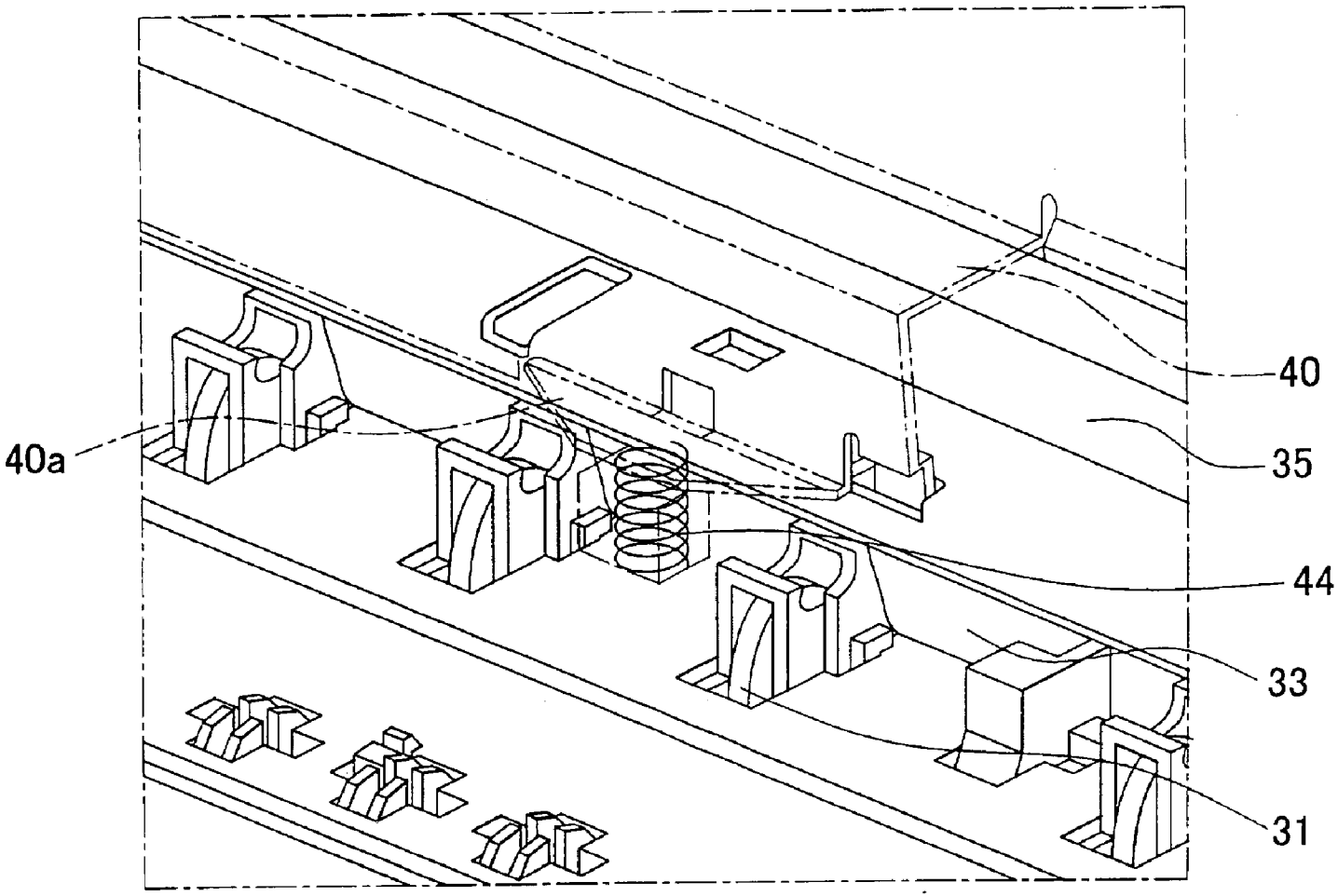
FIG. 18 is a perspective view of a part around the center of the lower discharge frame in the ink-jet printer according to the present invention.
Figure 19A:
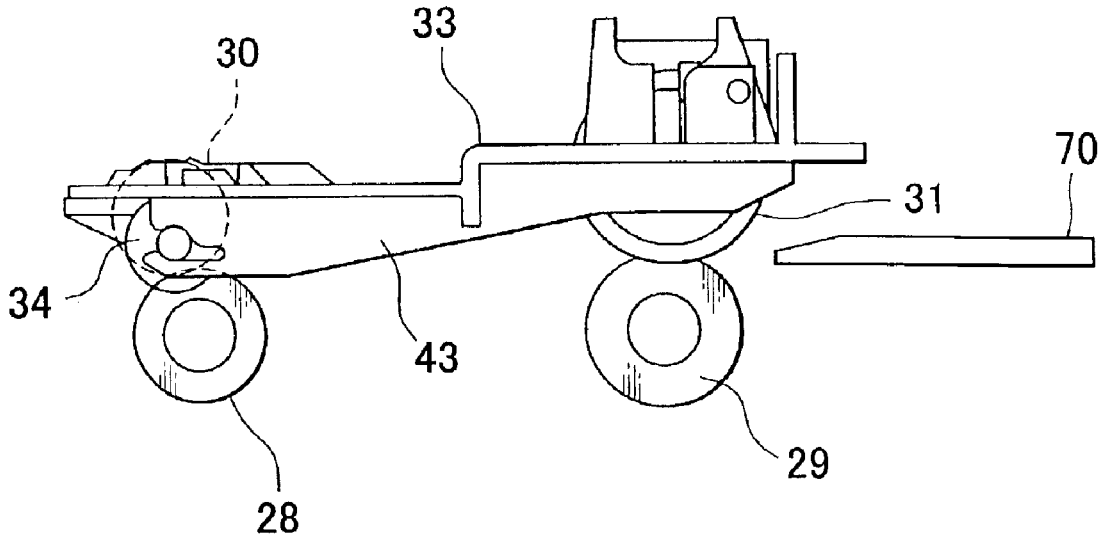
FIGS. 19A and 19B are side views of the lower discharge frame in the ink-jet printer according to the present invention.
Figure 19B:
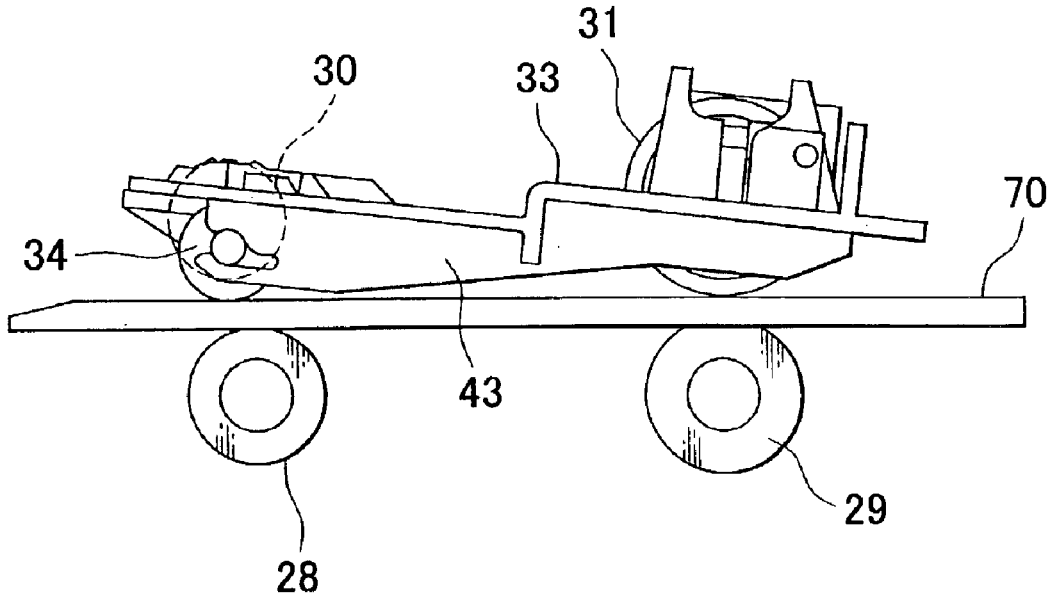

Referring to FIGS. 16A to 19B, attachment of the lower discharge frame 33 is described in detail. FIG. 16A is a perspective view of the right end of the lower the discharge frame 33; and FIG. 16B is a perspective view of the left end thereof. FIG. 17 is a view of the lower the discharge frame 33 when being seen from the front side (downstream side) of the printer 1. FIG. 18 is a perspective view of the center area of the lower the discharge frame 33. FIGS. 19A and 19B are side views of the lower discharge frame 33.

In FIGS. 16A and 16B, a right frame engagement portion 6*b* is formed in the right side frame 6 in form of an L-shaped hook, and is engaged with a right engagement portion 33*d* formed by an L-shaped hook formed at the right-front end (downstream side) of the lower discharge frame 33. On the backside (upstream) of the right frame engagement portion 6*b* in the right side frame 6, a protrusion 6*c* is formed to project toward the lower discharge frame 33 in such a manner that the right-back end (upstream side) of the lower discharge frame 6 can be placed on the protrusion 6*c*. The left side frame 7 and the left end the lower discharge frame 33 are arranged similarly. A left frame engagement portion 7*b* is engaged with a left engagement portion 33*e*, each of the portions 7*b* and 33*e* being formed by an L-shaped hook. Moreover, a protrusion 33*c* formed in the lower discharge frame 33 so as to project from the left side frame 7 to the outside can be placed on a rim of a hole formed in the left side frame 7, as shown in FIG. 16B. According to the above arrangement, the lower discharge frame 33 can pivot around a front end (downstream end), i.e., by means of the right and left frame engagement portions 6*b* and 7*b* serving as the pivot center, so as to move the backside (downstream side) of the frame 33 upwardly.

Moreover, the right side frame 6 has a spring retaining portion 6*a* for retaining one end of a coil spring 45*a*. Also, the lower discharge frame 33 has a spring retaining portion 33*a* for retaining another end of the coil spring 45*a*, formed around the center in the upstream-downstream direction at the right end thereof. By retaining the coil spring 45*a* by these spring retaining portions, a force for pulling the lower discharge frame 33 toward the front side. On the other hand, the left side of the lower discharge frame 33 is similarly arranged. A coil spring 45*b* is retained by a spring retaining portion 7*a* formed on the left side frame 7 and a spring retaining portion 33*b* formed at a position on the lower discharge frame 33, the position being located in the left part around the center, thereby applying a force to the lower discharge frame 33 in such a direction that the lower discharge frame 33 is pulled toward the front side. Thus, the lower discharge frame 33 is resiliently held by the right and left side frames 6 and 7 by the spring forces applied by the coil springs 45*a* and 45*b*. Please note that the spring retaining portions 6*a* and 7*a* are formed on the lower level with respect to the spring retaining portions 33*a* and 33*b*. Thus, the forces for pulling from the beneath toward the front side are applied to the lower discharge frame 33 by the coil springs 45*a* and 45*b*, preventing the upstream end of the lower discharge frame 33 from being elevated.

Next, a spring mechanism for springing the top surface of the lower discharge frame 33 in a downward direction, a distortion regulating section for regulating the distortion of the lower discharge frame 33, and a bending-moment reducing section for reducing bending moment of the lower discharge frame 33 are described.

Referring to FIG. 17, the lower discharge frame 33 extends along the column direction (horizontal direction in FIG. 17) and is resiliently supported at its ends by the right and left side frames 6 and 7, mentioned above. Therefore, the lower discharge frame 33 is held like a beam having free ends. On the other hand, the lower discharge frame 33 has a plurality of first paper-discharge driven rollers 30 and a plurality of discharge-driven rollers 31 arranged in the column direction, as described above, and these rollers 30 and 31 are brought into resilient contact with the associated discharge-driving rollers 28 and 29 positioned below the rollers 30 and 31 by the springing mechanism (bar spring 32 shown in FIGS. 7A and 7B). Therefore, the lower discharge frame 33 receives an upward load applied by these rollers so as to tend to bend in such a direction that the lower discharge frame 33 becomes convex upward. In other words, it can be considered that a plurality of loads concentrated be applied onto the beam supported at both ends.

When the lower discharge frame 33 bends towards such a direction it becomes convex upward, the following disadvantage is caused. The first paper-discharge driven rollers 30 and the second paper-discharge driven rollers 31 are brought into contact with the recording surface of the recording medium vertically with respect to the recording surface while the lower discharge frame 33 does not bend and is kept horizontally. However, if the lower discharge frame 33 bends in such a manner that it becomes convex upward, the rollers 30 and 31 cannot be in contact with the recording surface vertically. Especially in a case where the first paper-discharge driven rollers 30 are formed by toothed rollers described referring to FIGS. 7A and 7B, that have teeth on their outer circumferences, the first paper-discharge driven rollers 30 may cut the recording surface while being rotated, if the rollers 30 are not brought into contact with the recording surface vertically. This may cause the recording surface to be damaged.

In order to prevent the aforementioned disadvantage, in the printer 1 of the present embodiment, a coil spring 44 is provided for springing the top surface (the surface opposite to the surface on the side closer to the path of the recording medium) of the lower discharge frame 33 in the downward direction, at a position around the center in the column direction of the lower discharge frame 33. The coil spring 44 applies a spring force to a lower surface of a spring contact portion 40*a*, that is a folded part of an auxiliary frame 40 provided above the upper discharge frame 35 and the top surface of the lower discharge frame 33. The spring contact portion 40*a* is folded in the horizontal direction, as shown in FIG. 18. Therefore, the downward spring force applied by the coil spring 44 counters with the upward loads applied by the first and second paper-discharge driven rollers 30 and 31, thereby suppressing the bending of the lower discharge frame 33 in such a direction that the lower discharge frame 33 becomes convex upward. As a result, it becomes possible for the first paper-discharge driven rollers 30 to be always brought into contact with the recording surface vertically for a long time. Thus, a high printing quality can be kept.

Please note that the coil spring 44 in the present embodiment cannot obstruct the reciprocation of the carriage 23 in the main scanning direction because the coil spring 44 is arranged on the lower discharge frame 33 in the vicinity of the second paper-discharge driven rollers 31, as is shown in FIG. 18.

The aforementioned coil spring 44 can be regarded as forming a "bending regulating mechanism" for regulating the bending of the lower discharge frame 33 or a "bending moment reducing mechanism" for reducing bending moment generated in the lower discharge frame 33. Therefore, other elastic component than the coil spring 44 can be used. Moreover, instead of applying the force to the lower discharge frame 33 in a resilient manner, a mechanism for applying the force in a non-resilient manner. A point of application of the force applied to the lower discharge frame 33 is not limited to a single point positioned around the center in the column direction as described in the present embodiment. A plurality of points of application of the force can be arranged in the column direction.

Next, a mechanism for pivoting the lower discharge frame 33, i.e., a mechanism for changing the lower discharge frame 33 between the "non-contact posture" and the "contact posture," referring to FIGS. 19A and 19B.

As shown in FIGS. 19A and 19B, a roller holder 43 provided on the lower discharge frame 33 supports a single release roller 34 at its axis ends in such a manner that the release roller 34 can be freely rotated. The release roller 34 is provided on the upstream of the left end of the lower discharge frame 33, as shown in FIGS. 4A and 4B. Moreover, the release roller 34 is arranged in such a manner that the lowermost level that the release roller 34 can reach is lower than the lowermost level that the first paper-discharge driven rollers 30 reach, as shown in FIGS. 19A and 19B. When the tray 70 has been inserted between the second paper-discharge driving roller 29 and the second paper-discharge driven rollers 31 toward the upstream side, as shown in FIG. 19A, the left side of the tray 70, i.e., a region of the tray 70 other than a region for which the printing is to be performed (that is, a region other than the convex portion 71 (see FIGS. 5A and 5B) into which an optical disk can be placed) is brought into contact with the release roller 43 so as to move the release roller 34 in the upward direction. Thus, the posture of the lower discharge frame 33 is changed to the non-contact posture, so that the first paper-discharge driven rollers 30 are moved away to positions where the rollers 30 are not in contact with the recording surface of the optical disk placed in the tray 70.

In other words, since the tray 70 serving as the transferred medium directly causes the change of posture of the lower discharge frame 33 so as to move the first paper-discharge driven rollers 30 upwardly, the cost can be reduced as compared with an arrangement in which a user manually changes the posture of the lower discharge frame 33 by means of an operation lever and a link mechanism, for example. Moreover, it is possible to prevent the printing operation from being performed without moving the first paper-discharge driven rollers 30 upward. Therefore, the data storage area directly below the recording surface of the optical disk can be protected without fail. Furthermore, since the transferred medium moves the first paper-discharge driven rollers 30 upward, the moving amount of the first paper-discharge driven rollers 30 is precisely controlled.

Please note that the release roller 34 is not necessarily a body of rotation because the release roller 34 serves as an "engaging portion" for engaging the region other than the recording region of the inserted tray 70 to change the posture of the lower discharge frame 33. However, by forming the release roller 34 by the body of rotation as in the present embodiment, it is possible to insert the tray 70 smoothly with no load. Moreover, in the present embodiment, the release roller 34 is arranged at a position outside the region for which the printing operation can be performed, that is, a position outside a profile of a sheet of cut paper P, a board or the like transferred from the backside of the printer 1

(transferred medium transferred in the direction shown with Arrow 1 or 2). Therefore, if the medium is transferred from the backside of the printer 1, the medium does not move the first paper-discharge driven rollers 30 upward, thereby an appropriate discharge operation can be performed by the first transfer roller 26 and the second transfer roller 27.

<5. Arrangement of a Release Mechanism for the Second Paper-discharge Driven Roller>

Figure 20:
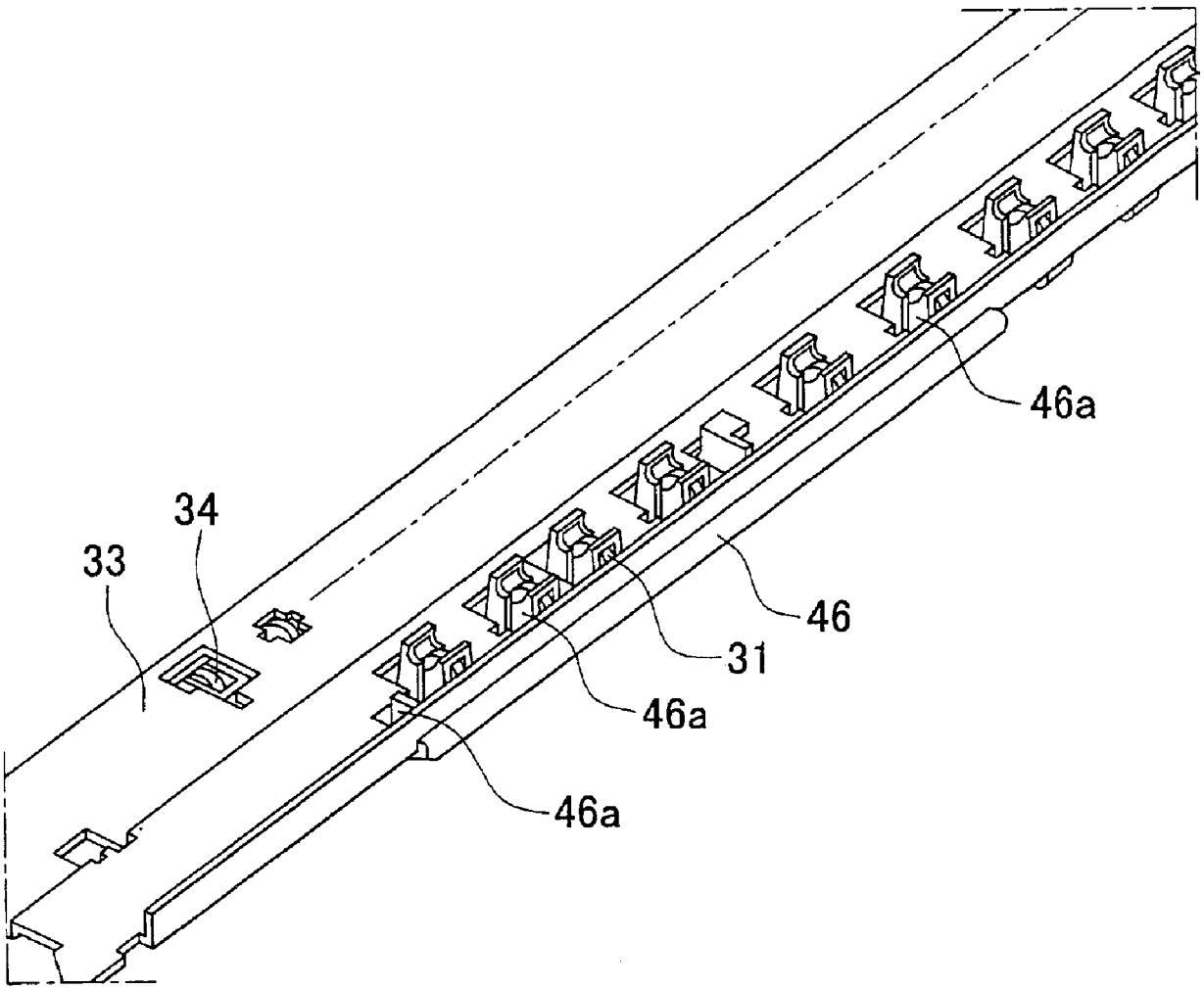
FIG. 20 is a perspective view showing the appearance of the lower discharge frame in the ink-jet printer according to the present invention.
Figure 21A:
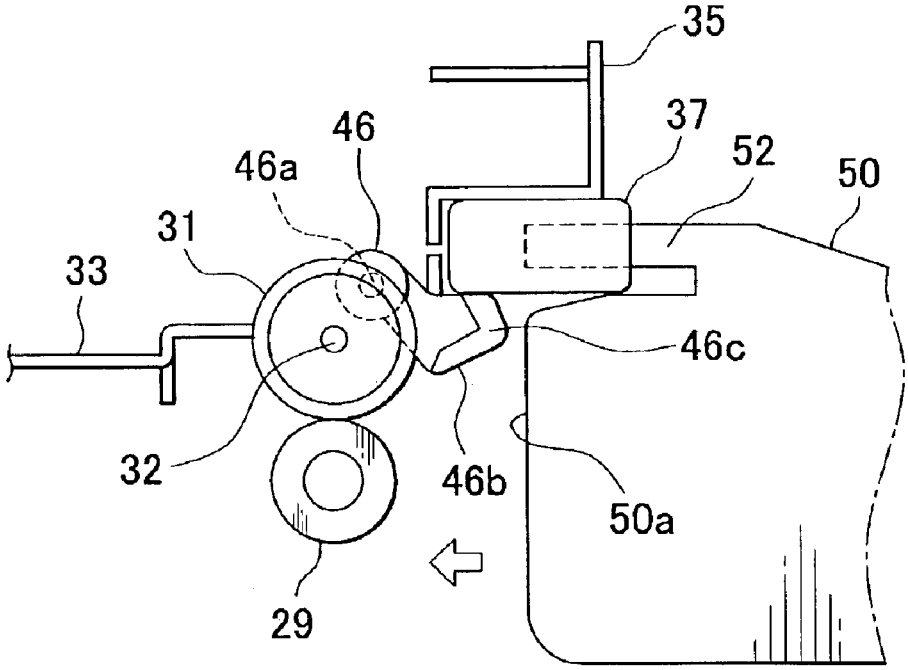
FIGS. 21A and 21B are cross-sectional views (partially enlarged) of the lower discharge frame in the ink-jet printer according to the present invention, seen from the side thereof.
Figure 21B:
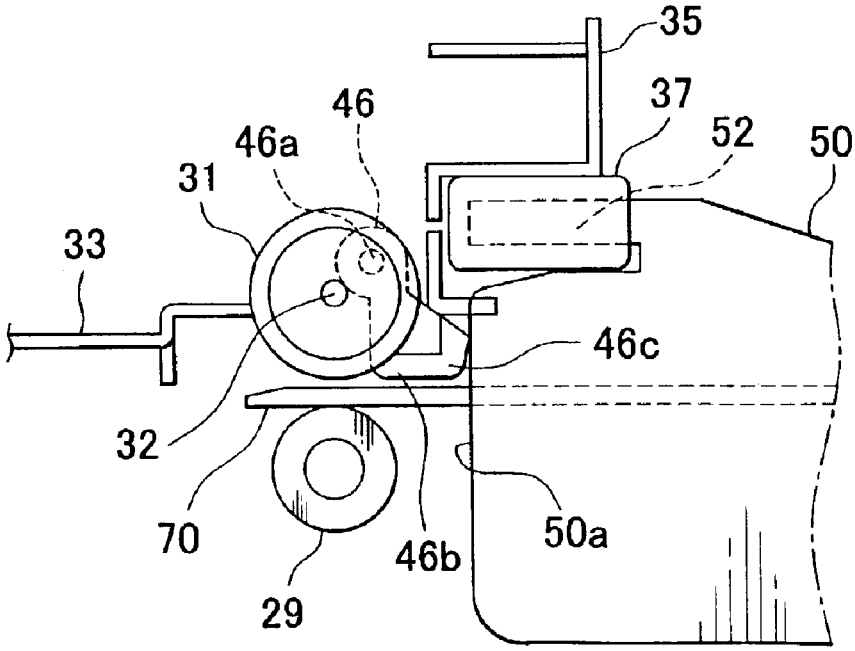

Referring mainly to FIGS. 20, 21A and 21B, a release mechanism for moving the second paper-discharge driven rollers 31 away from the second paper-discharge driving roller 28 is described. FIG. 20 is a perspective view showing the appearance of the lower discharge frame 33. FIGS. 21A and 21B are cross sectional views of the lower discharge frame 33 (partially enlarged).

A roller release member 46 (hereinafter, simply referred to as a "release member") extending along the longitudinal direction of the lower discharge frame 33 is provided at the downstream end of the lower discharge frame 33 in such a manner that the position of the roller release member 46 in the longitudinal direction of the lower discharge frame 33 is closer to the left end of the lower discharge frame 33 than to the right end thereof, as shown in FIG. 20. More specifically, the position of the release member 46 in the longitudinal direction of the lower discharge frame 33 is the same as the position of the adapter attachment portion 37 in the longitudinal direction of the lower discharge frame 33, as shown in FIG. 4A. The position of the release member 46 is determined in such a manner that the release member 46 is engaged with a top end of the adapter 50 (or is pressed by the adapter 50) when the adapter 50 is attached to the adapter attachment portion 37.

Referring to FIGS. 21A and 21B, the details of the release mechanism is described. In FIG. 21A, the release member 46 has a rotation axis 46*a* extending along the longitudinal direction of the lower discharge frame 33 and is pivotable around the rotation axis 46*a*. From the rotation axis 46*a*, a contact portion 46*b* that can be brought into contact with the outer circumference of the second paper-discharge driven roller 31 is formed to extend in the downward direction. When the release member 46 is pivoted around the rotation axis 46*a*, the contact portion 46*b* is brought into contact with the outer circumference of the second paper-discharge driven rollers 31.

On the other hand, the side (the right side in FIG. 21A) of the release member 46 opposite to the contact portion 46*b* forms an adapter engagement portion 46*c* located under the adapter attachment portion 37. When a protrusion 52 of the adapter 50 fits into the adapter attachment portion 37, as shown in FIG. 21A, the top face 50*a* of the adapter 50 is brought into contact with the adapter engagement portion 46*c* so as to move the release member 46 in such a direction that the contact portion 46*b* is brought into contact with the outer circumference of the second paper-discharge driven roller 31. Consequently, the release member 47 releases the second paper-discharge driven rollers 31 from the second paper-discharge driving roller 29 against the spring force applied by the bar spring 32 serving as the rotation axis of the second paper-discharge driven rollers 31, as shown in FIG. 21B.

Next, the advantageous effects of the roller release mechanism having the aforementioned arrangement are described. In the printer 1, the adapter 50 in which the tray 70 is inserted can be attached or removed to/from the adapter attachment portion 37, as described above. When the tray 70 is manually inserted between the second paper-discharge driven rollers 31 and the second paper-discharge driving roller 29, the adapter 50 is attached to the adapter attachment portion 37 in such a manner that the tray 70 is manually fed via the adapter 50. On the other hand, an optical disk placed in the tray 70 has low permeability of ink and therefore ink transfer can occur easily by the contact between the recording surface of the optical disk and the second paper-discharge driven rollers 31. Moreover, since the discharge operation for the tray 70 can be performed by the transfer roller 19 (see FIG. 2), it is not necessary to nip the tray 70 between the second paper-discharge driven rollers 31 and the second paper-discharge driving roller 19. Therefore, in order to perform the printing operation for the optical disk by using the tray 70 in an appropriate manner, it is necessary to release the second paper-discharge driven rollers 31 from the second paper-discharge driving roller 29. However, if the printer 1 adopts the arrangement in which the user manually moves the second paper-discharge driven roller 31 away from the second paper-discharge driving roller 29 prior to start of the printing operation, it is likely that the user forgets to release the second paper-discharge driven rollers 31.

In the printer 1 of the present embodiment, however, a part (top face 50*a*) of the adapter 50 is brought into contact with the release member 46 when the adapter 50 is attached to the adapter attachment portion 37, so as to release the second paper-discharge driven rollers 31 from the second paper-discharge driving roller 29. Thus, when the tray 70 is manually inserted, the second paper-discharge driven rollers 31 are always away from the second paper-discharge driving roller 29. Therefore, it is possible to prevent the faulty operation by the user, that is, omission of the operation for releasing the second paper-discharge driven rollers 31, in a case of performing the printing operation for the optical disk by using the tray 70.

In the present embodiment, the release member 46 is arranged to be brought into contact with one(s) (six rollers 31 in the present embodiment) of the second paper-discharge driven rollers 31 arranged along the column direction that are(is) located in the region of the tray 70 that is fed from the adapter 50. Therefore, it is not necessary to release unnecessary second paper-discharge driven rollers 31, thereby reducing the cost of the release member 46.

Moreover, in the present embodiment, the adapter 50 is formed as an exclusive component for appropriately feeding the tray 70. However, not only the tray 70 but also a thick medium such as a board can be fed by using the adapter 50 and be discharged onto the adapter 50. In this case, the adapter 50 serves as both paper-feeding tray and a paper-discharging tray that support the thick medium such as the board from the beneath the medium, and can have a function of regulating the position of the medium in the column direction when the medium is fed.

As described above, according to the present invention, when a transferred medium is inserted between a discharge-driving roller and a discharge-driven roller toward the upstream side of a liquid emitting apparatus, a region of the transferred medium other than a region thereof onto which liquid is emitted directly moves a discharge frame, that is, an engagement portion away so as to release the discharge-driven roller from the discharge-driving roller. Therefore, an operation lever, a link mechanism and the like, that were conventionally used for changing the posture of discharge frame between the contact posture and the non-contact posture are not required, simplifying the arrangement for releasing the discharge-driven roller from the discharge-driving roller and reducing the cost. Moreover, according to the present invention, when the transferred medium has been inserted, the transferred medium always moves the discharge-driven roller away from the discharge-driving roller. Therefore, an improper operation by the user can be prevented.

Although the present invention has been described by way of exemplary embodiments, it should be understood that those skilled in the art might make many changes and substitutions without departing from the spirit and the scope of the present invention which is defined only by the appended claims.

What is claimed is:

1. A discharge device for discharging a medium, comprising:

a discharge-driving roller provided on a downstream side of a liquid emitting head for emitting liquid onto said medium, operable to be driven to rotate;

a discharge-driven roller, biased by a biasing mechanism toward said discharge-driving roller, operable to be brought into contact with said discharge-driving roller to be rotated by said discharge-driving roller;

a discharge frame, to which said discharge-driven roller is attached, having a posture changeable between a contact posture that brings said discharge-driven roller into contact with said discharge-driving roller and a release posture that moves said discharge-driven roller away from said discharge-driving roller; and an engagement portion, provided on said discharge frame, operable to engage with an outside region of said medium inserted between said discharge-driving roller and said discharge-driven roller toward an upstream side against a force applied by said biasing mechanism, said outside region being a region other than a liquid-emitted region of said medium onto which said liquid is to be emitted, wherein said medium is discharged by rotation of said discharge-driving roller, and said outside region of said medium moves said engagement portion away to change said posture of said discharge frame from said contact posture to said release posture, when said medium is inserted between said discharge-driving roller and said discharge-driven roller toward the upstream side.

2. A discharge device as claimed in claim 1, wherein said discharge frame is arranged in such a manner that an upstream side thereof is pivotable around a pivot center at a downstream side thereof, and said engagement portion is provided on said upstream side of said discharge frame.

3. A discharge device as claimed in claim 2, wherein a plurality of discharge-driven rollers are arranged at intervals in an width direction of said medium that is perpendicular to a direction along which said medium is transferred, and said engagement portion is arranged in the vicinity of an outermost one of said discharge-driven rollers that is located at an end in said transverse direction.

4. A discharge device as claimed in any one of the preceding claims, wherein said engagement portion is arranged on a side opposite to a reference position side determining a reference position of said medium in said width direction.

5. A discharge device as claimed in any one of claims 1–3, wherein said engagement portion is formed by a body of rotation that is brought into contact with said medium to be rotated.

6. A discharge device as claimed in any one of claims 1–3, wherein said discharge-driven roller is a toothed roller having teeth on its outer circumference.

7. A discharge device as claimed in any one of claims 1–3, wherein said engagement portion is arranged in a region other than a region where said liquid emitting head is able to emit said liquid.

8. A discharge device as claimed in any one of claims 1–3, further comprising an advance roller that includes:

an advance-driving roller, provided in the downstream of said discharge-driving roller, operable to be driven to rotate; and an advance-driven roller, biased by a biasing mechanism toward said advance-driving roller, operable to be brought into contact with said advance-driving roller to be rotated by said advance-driving roller.

9. A discharge device as claimed in claim 8, further comprising:

an adapter attachment portion to which a positioning adapter for supporting said medium from the beneath said medium and regulating a position of said medium in a column direction when said medium is manually inserted from the downstream of said advance roller to the upstream of said transfer roller, is attached; and a roller release member, provided to be brought into contact with an outer circumference of said advance-driven roller, operable to moves said advance-driven roller away from said advance-driving roller against said biasing mechanism when being in contact with said outer circumference of said advance-driven roller, wherein a part of said positioning adapter is brought into contact with said roller release member to move said transfer-driven roller away from said transfer-driving roller, when said positioning adapter was attached to said adapter attachment portion.

10. A discharge device as claimed in claim 9, wherein said advance-driven roller is an elastic roller that is brought into fact-contact with said medium resiliently.

11. A liquid emitting apparatus comprising:

a liquid emitting head operable to emit liquid toward a medium; and a discharge device, provided in a downstream of said liquid emitting head, operable to discharge said medium outside said apparatus, wherein said discharge device is a discharge device as claimed in any one of claims 1—3.

* * * * *